US007176625B2

(12) United States Patent
Mochizuki et al.

(10) Patent No.: US 7,176,625 B2
(45) Date of Patent: Feb. 13, 2007

(54) PHOTOCATHODE PLATE AND ELECTRON TUBE

(75) Inventors: Tomoko Mochizuki, Hamamatsu (JP); Minoru Niigaki, Hamamatsu (JP); Toru Hirohata, Hamamatsu (JP); Kuniyoshi Mori, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/969,319

(22) Filed: Oct. 21, 2004

(65) Prior Publication Data

US 2006/0038473 A1 Feb. 23, 2006

(30) Foreign Application Priority Data

Aug. 17, 2004 (JP) ..... P2004-237661

(51) Int. Cl.
*H01J 40/06* (2006.01)

(52) U.S. Cl. ..... 313/542; 313/544

(58) Field of Classification Search ..... 313/530–544, 313/373, 375, 383
See application file for complete search history.

(56) References Cited

U.S. PATENT DOCUMENTS 5,047,821 A 9/1991 Costello et al.
5,912,500 A 6/1999 Costello et al.
6,376,985 B2 * 4/2002 Lee et al. ..... 313/542
6,563,264 B2 * 5/2003 Niigaki et al. ..... 313/527
2001/0001226 A1 * 5/2001 Nihashi ..... 313/542
2003/0048075 A1 * 3/2003 Lim et al. ..... 313/542

FOREIGN PATENT DOCUMENTS

JP 08-255580 10/1996
JP 2000021295 A * 1/2000

* cited by examiner

*Primary Examiner*—Ashok Patel
*Assistant Examiner*—Christopher M. Raabe
(74) *Attorney, Agent, or Firm*—Drinker Biddle & Reath LLP

(57) ABSTRACT

Provided are a photocathode plate capable of stably achieving a high sensitive property, and an electron tube using such a photocathode plate.

In a photomultiplier tube 1, an insulating layer 63 is formed between a semiconductor electron emission layer 51 in a photocathode plate 23A, and a first electrode 65 electrically connected to an electron releasing portion 59. This insulating layer 63 permits the photocathode plate 23A to be cleaned by heat cleaning at a high temperature, in a stage before formation of an active layer 61 on an exposed region of the semiconductor electron emission layer 51 in the electron releasing portion 59. This makes it feasible to effectively clean the exposed region of the semiconductor electron emission layer 51 in the electron releasing portion 59 and to stabilize the physical properties of the exposed region. In consequence, a higher sensitive property can be stably achieved in the photocathode plate 23A and in the photomultiplier tube 1 using the photocathode plate 23A.

4 Claims, 28 Drawing Sheets

PHOTOCATHODE PLATE AND ELECTRON TUBE

BACKGROUND OF THE INVENTION

1. Field of the Invention

The present invention relates to a photocathode plate for releasing photoelectrons through photoelectric conversion of incident light, and an electron tube using such a photocathode plate.

2. Related Background Art

In the photocathode plate of this type, a semiconductor light absorbing layer and a semiconductor electron emission layer are deposited in this order on a semiconductor substrate, and an electron releasing portion for outwardly releasing photoelectrons is formed on the semiconductor electron emission layer. Furthermore, an electrode electrically connected to the electron releasing portion is formed on the semiconductor electron emission layer (e.g., reference is made to the specification of Japanese Patent No. 2923462).

SUMMARY OF THE INVENTION

Incidentally, concerning the photocathode plates as described above, there have been desires heretofore for stably achieving a high sensitive property.

The present invention has been accomplished under such circumstances and an object of the present invention is to provide a photocathode plate capable of stably achieving a high sensitive property, and an electron tube using such a photocathode plate.

In order to achieve the above object, a photocathode plate according to the present invention is a photocathode plate for releasing photoelectrons through photoelectric conversion of incident light, comprising: a semiconductor substrate; a semiconductor light absorbing layer formed on the semiconductor substrate and adapted to absorb incident light to generate photoelectrons; a semiconductor electron emission layer formed on the semiconductor light absorbing layer and adapted to accelerate the photoelectrons generated in the semiconductor light absorbing layer; an electron releasing portion formed on the semiconductor electron emission layer and adapted to outwardly release the photoelectrons accelerated by the semiconductor electron emission layer; a first electrode electrically connected to the electron releasing portion; an insulating layer formed between the semiconductor electron emission layer and the first electrode; and a second electrode formed on the semiconductor substrate.

In this photocathode plate, the insulating layer is formed between the semiconductor electron emission layer and the first electrode electrically connected to the electron releasing portion. The Inventor found that the formation of such an insulating layer permitted the photocathode plate to be cleaned by heat cleaning at a high temperature, in a stage before formation of an active layer on an exposed region of the semiconductor electron emission layer in the electron releasing portion. This makes it feasible to effectively clean the exposed region of the semiconductor electron emission layer in the electron releasing portion and to stabilize the physical properties of the exposed region. In consequence, this photocathode plate is able to stably achieve a high sensitive property.

The insulating layer is preferably formed so as to cover a region without the electron releasing portion on the semiconductor electron emission layer. In this case, the temperature resistance of the photocathode plate can be further improved, and it thus becomes feasible to perform the heat cleaning at a higher temperature. This makes it feasible to more effectively clean the exposed region of the semiconductor electron emission layer in the electron releasing portion and to more stabilize the physical properties of the exposed region. As a result, this photocathode plate is able to stably achieve a higher sensitive property.

An electron tube according to the present invention is characterized by comprising the aforementioned photocathode plate.

This electron tube uses the photocathode plate in which the insulating layer is formed between the semiconductor electron emission layer and the first electrode electrically connected to the electron releasing portion, as described above. Therefore, the photocathode plate of this electron tube is able to stably achieve a high sensitive property. The electron tube stated herein is a device for detecting weak light through the use of the photocathode plate, for example, which encompasses a photomultiplier tube, a streak tube, an image intensifier, and so on.

DESCRIPTION OF THE PREFERRED EMBODIMENTS

Figure 1:
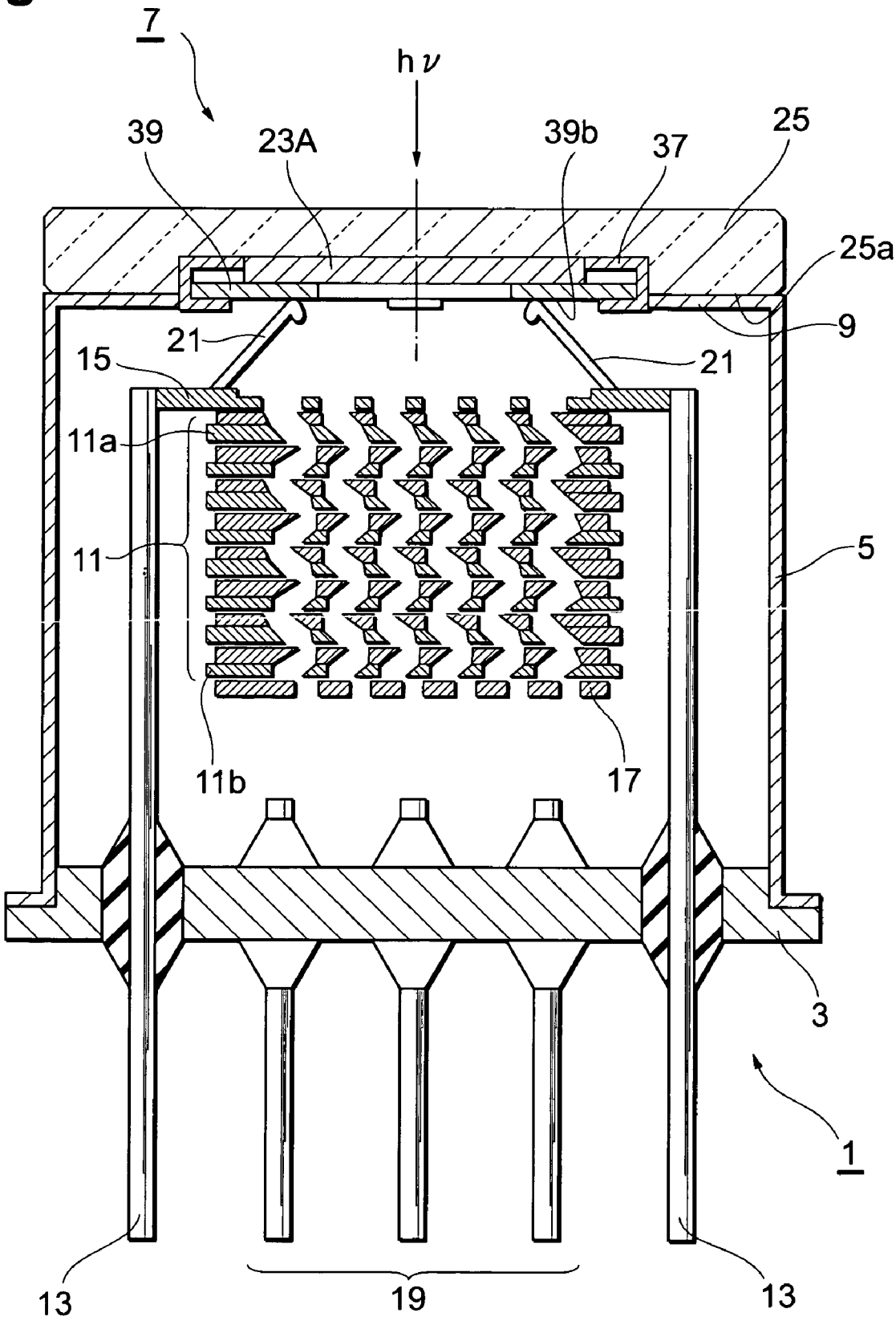
FIG. 1 is a sectional view showing a photomultiplier tube which is an embodiment of the electron tube according to the present invention.

The preferred embodiments of the photocathode plate and the electron tube according to the present invention will be described below in detail with reference to the drawings. It is noted that the terms including "up," "down," etc. are based on the states shown in the drawings and are introduced for convenience' sake.

First Embodiment

FIG. 1 is a sectional view showing a photomultiplier tube being an embodiment of the electron tube according to the present invention. In the photomultiplier tube 1, as shown in FIG. 1, a metal side tube 5 is airtightly fixed to a metal stem 3 and a photocathode 7 is airtightly fixed to an upper end of this side tube 5, thereby forming a vacuum vessel.

Metal channel dynodes 11 are set in the vacuum vessel formed as described above. A focusing electrode 15 of lattice shape connected to stem pins 13 is set between the metal channel dynodes 11 and the photocathode 7, and an anode 17 connected to stem pins 19 is set between the metal channel dynodes 11 and the stem 3.

Furthermore, a pair of electrodes 21 extending as inwardly inclined toward a lower surface 39*b* of a support plate 39 described later are integrally formed with the focusing electrode 15. Upper ends of the electrodes 21 are pressed against a second electroconductive film 43 (cf. FIG. 2) formed on the lower surface 39*b* of the support plate 39.

Figure 2:
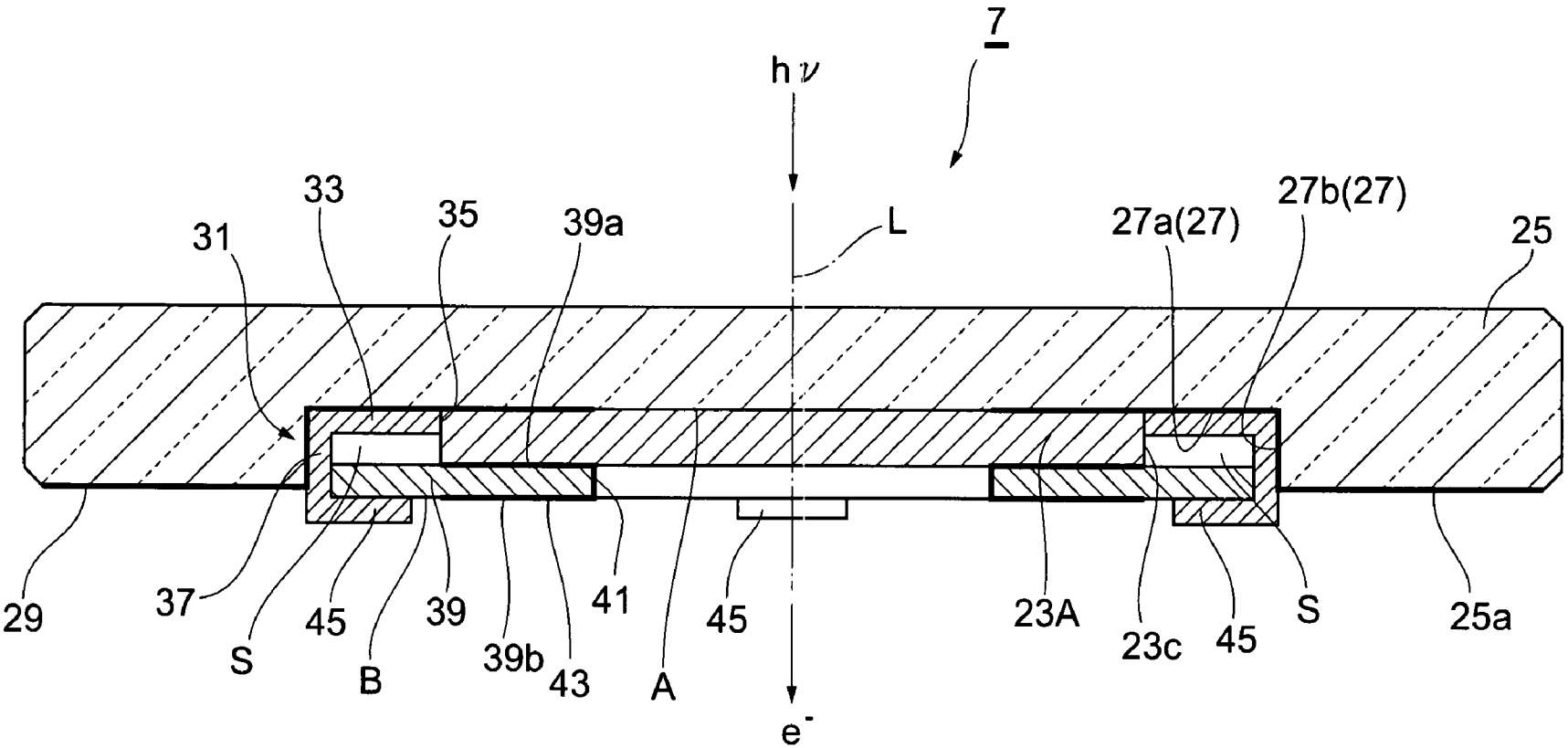
FIG. 2 is a sectional view of a photocathode in the photomultiplier tube shown in FIG. 1.

The foregoing photocathode 7 is a field assist type photocathode of a transmission type incorporating a photocathode plate (a semiconductor crystal functioning as a photocathode surface) 23A for sensing incident light (hν) and emitting photoelectrons ($e^-$), as shown in FIG. 2, and is used as a photoelectric conversion part in the photomultiplier tube 1. This photocathode 7 has a light transmitting plate 25 of disk shape made of silica glass, and a circular recess 27 centered on an axis L is formed in a lower surface 25*a* of this light transmitting plate 25.

Figure 3:
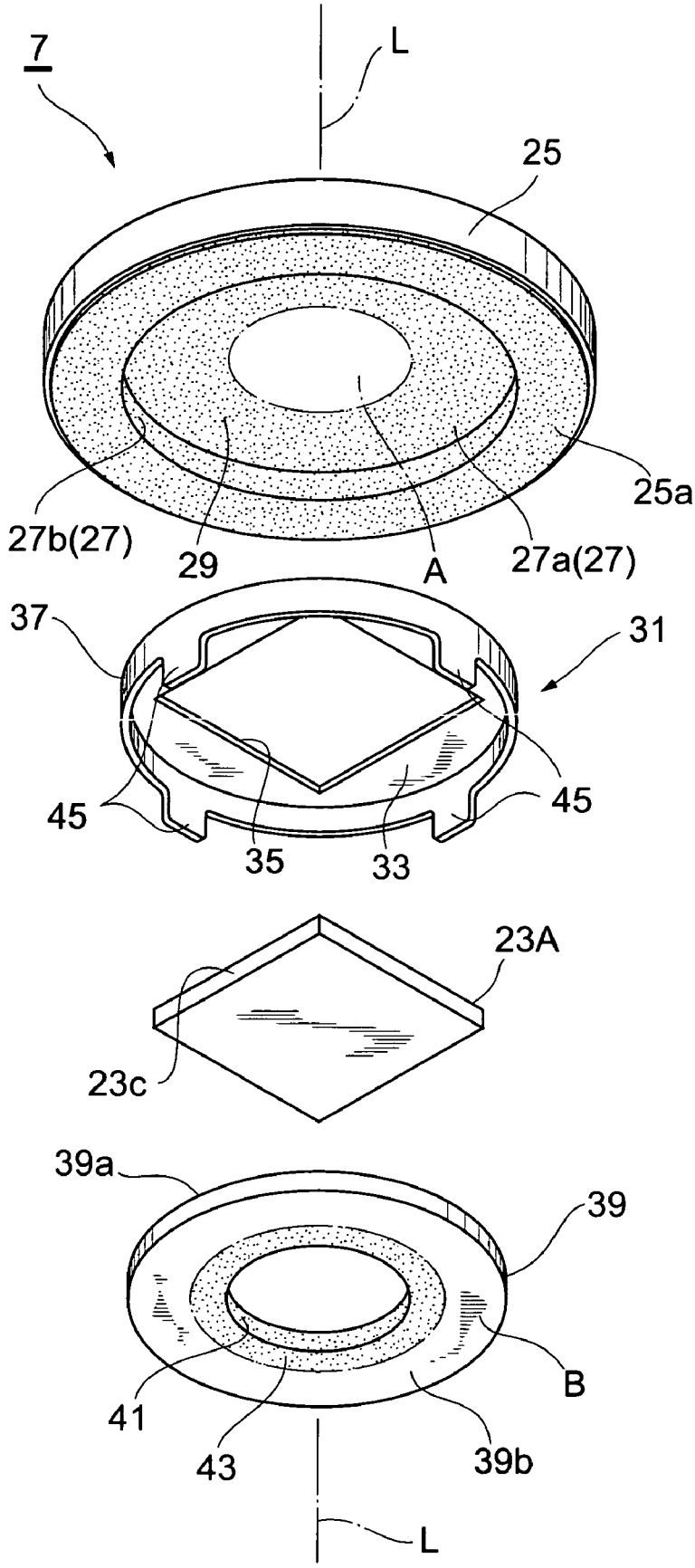
FIG. 3 is an exploded perspective view of the photocathode shown in FIG. 2.

A first electroconductive film 29 of Cr is formed in a region except for a circular light passing region A centered on the axis L, as shown in FIGS. 2 and 3, on a bottom surface 27*a* of this recess 27, and this first electroconductive film 29 uniformly extends from the bottom surface 27*a* of the recess 27 across a side face 27*b* and further over the lower surface 25*a* of the light transmitting plate 25 (the pearskin region in FIG. 3). In this configuration, light (hν) transmitted by the light transmitting plate 25 passes the light passing region A of the bottom surface 27*a*. The photocathode 7 is firmly fixed to the side tube 5 by In (indium) bonding between an inward flange 9 formed in the upper end region of the side tube 5, and the first electroconductive film 29 formed on the lower surface 25*a*. The first electroconductive film 29 is preferably made of a material selected from Cr, Ti, Cu, and so on in terms of good compatibility with silica glass and unlikeliness of occurrence of peeling-off, but may be made of any other material with electric conductivity.

On the other hand, a holding member 31 of Kovar for holding the photocathode plate 23A is fitted in the recess 27 of the light transmitting plate 25. This holding member 31 has a holding portion 33 of circular thin plate shape to contact the bottom surface 27*a* of the recess 27, and is firmly fixed to the light transmitting plate 25 by In bonding between the holding portion 33 and the electroconductive film 29 formed on the bottom surface 27*a*. The holding member 31 may be made of Ni, while securing a strong fixing force by In bonding.

A first aperture 35 of rectangular shape wider than the light passing region A is formed in this holding portion 33, and the photocathode plate 23A of rectangular thin plate shape in the same contour as the first aperture 35 when viewed from the direction of the axis L is fitted in the first aperture 35 so as to contact the light transmitting plate 25. This permits a second electrode 53 (cf. FIG. 6) of the photocathode plate 23A to be electrically connected to the first electroconductive film 29 exposed in the first aperture 35 of the holding portion 33.

Furthermore, an annular envelope 37 to be set along the side face 27*b* of the recess 27 is integrally formed in the peripheral edge of the holding portion 33. This envelope 37 surrounds the photocathode plate 23A with a space S with respect to a side face 23*c* of the photocathode plate 23A. A ceramic support plate 39 of circular shape in the same contour as the inner surface of the envelope 37 when viewed from the direction of the axis L is fitted in this envelope 37 so as to contact the photocathode plate 23A. A circular second aperture 41 for allowing photoelectrons ($e^-$) released from the photocathode plate 23A to pass is formed in this support plate 39.

A second electroconductive film 43 of Cr is formed in the marginal region on the second aperture 41 side of this support plate 39 (the pearskin region in FIG. 3). This second electroconductive film 43 is formed continuously from an upper surface 39*a* to a lower surface 39*b* of the support plate 39 through a wall surface of the second aperture 41 and is electrically connected to first electrodes 65 (cf. FIG. 5) of the photocathode plate 23A on the upper surface 39*a* side. The second electroconductive film 43 is preferably made of a material selected from Cr, Ti, Ag, and so on, because they generate no gas to cause degradation of vacuum in the electron tube, but it may also be made of any other material with electric conductivity.

Figure 4:
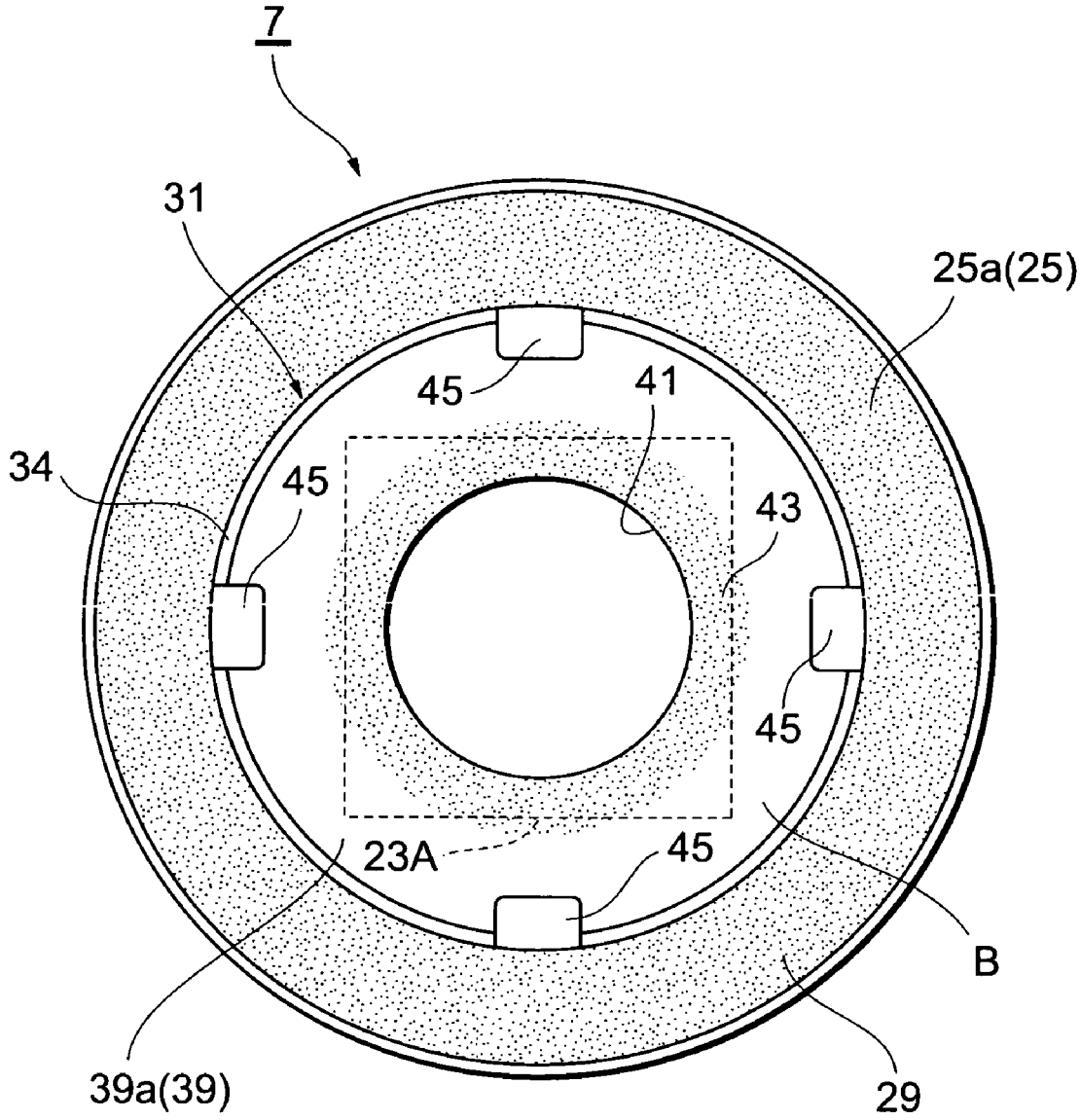
FIG. 4 is a bottom view of the photocathode shown in FIG. 2.

Furthermore, four claws 45 are integrally formed at equal intervals (at angles of 90°) around the axis L in the lower end part of the envelope 37. These claws 45 are bent at a right angle toward the axis L so as to be urged against a non-electroconductive region B (a region without the second electroconductive film 43) in the outer edge region of the lower surface 39*b* of the support plate 39, as shown in FIGS. 2 and 4, and they press the support plate 39 against the photocathode plate 23A. The number of claws 45 does not have to be limited to 4. For example, a pair of opposed claws 45 may be integrally formed in the lower end part of the envelope 37.

In the photomultiplier tube 1 constructed as described above, when light (hν) is incident into the photocathode 7 from the light transmitting plate 25 side, the photocathode 7 photoelectrically converts the light (hν) to emit photoelectrons ($e^-$) . The focusing electrode 15 focuses the emitted photoelectrons ($e^-$) on the first-stage dynode 11*a* of the metal channel dynodes 11. Then the photoelectrons ($e^-$) are successively amplified in the metal channel dynodes 11 and a secondary electron group is released from the final-stage dynode 11*b*. When this secondary electron group reaches the anode 17, it is outputted through the stem pins 19 connected to this anode 17, to the outside.

Subsequently, the foregoing photocathode plate 23A will be described in further detail.

Figure 5:
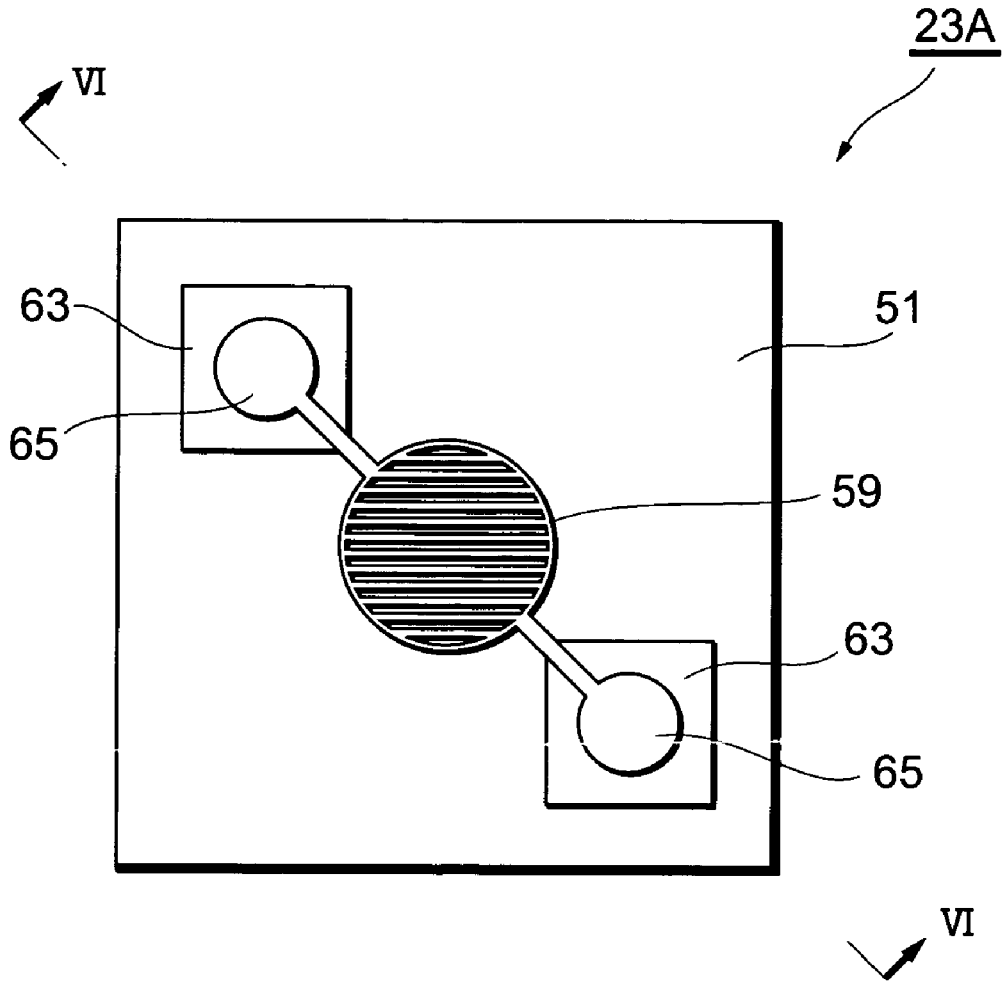
FIG. 5 is a plan view showing a first embodiment of the photocathode plate according to the present invention.
Figure 6:
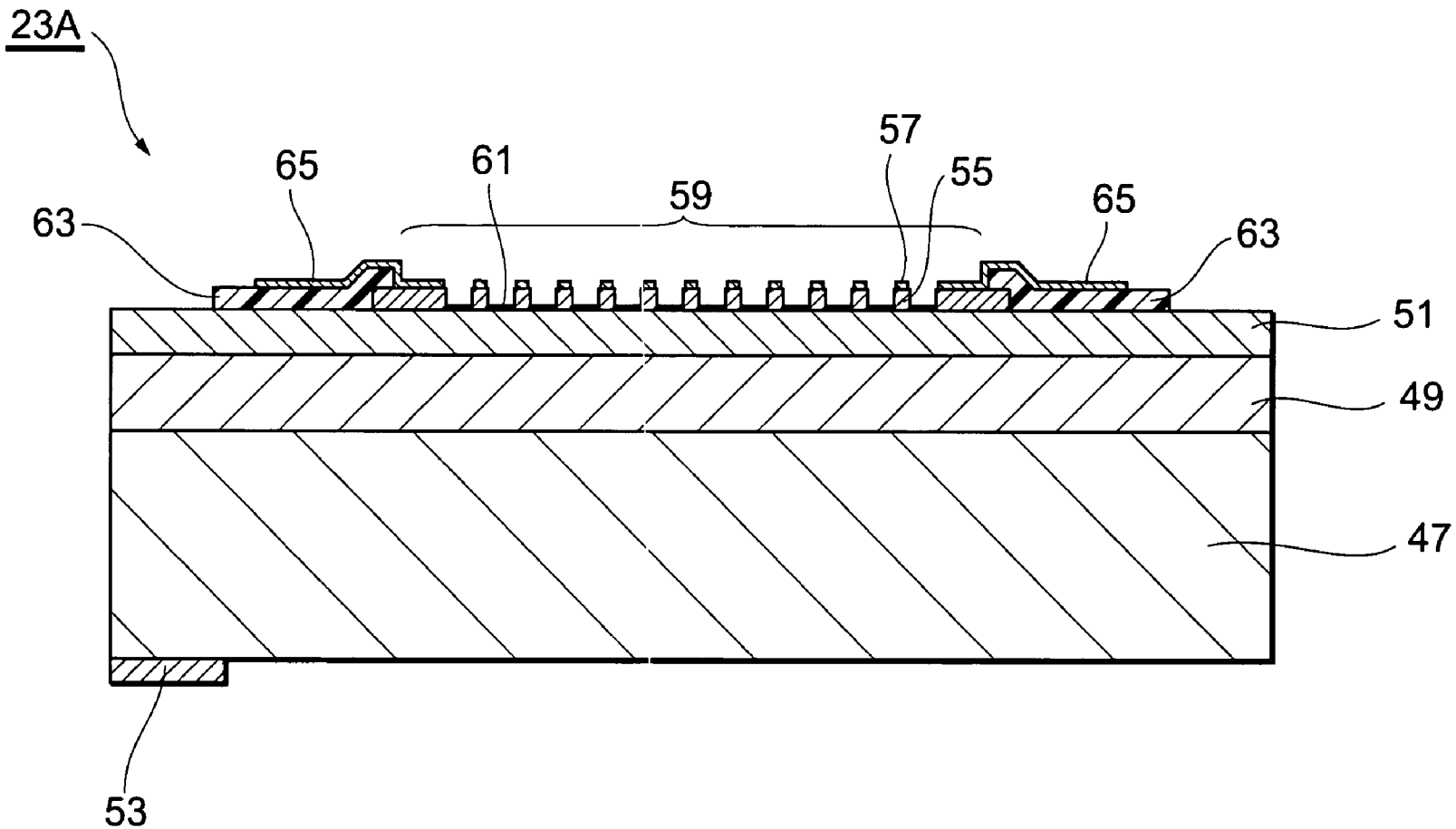
FIG. 6 is a sectional view along VI—VI line of the photocathode plate shown in FIG. 5.

As shown in FIGS. 5 and 6, the photocathode plate 23A has a semiconductor substrate 47, a semiconductor light absorbing layer 49 formed on the semiconductor substrate 47 and adapted to absorb incident light (hν) to generate photoelectrons ($e^-$), and a semiconductor electron emission layer 51 formed on the semiconductor light absorbing layer 49 and adapted to accelerate the photoelectrons ($e^-$) generated in the semiconductor light absorbing layer 49.

The semiconductor substrate 47 is made of InP with the conductivity type of the p-type and has the thickness of about 350 μm. The semiconductor light absorbing layer 49 is made of InGaAs with the conductivity type of the p-type and has the thickness of about 2.0 μm. The semiconductor electron emission layer 51 is made of InP with the conductivity type of the p-type and has the thickness of about 0.7 μm.

A contact layer 55 forming a pn junction with the semiconductor electron emission layer 51, and an electrode layer 57 in ohmic contact with the contact layer 55 are stacked in this order on the upper surface of the semiconductor electron emission layer 51. The contact layer 55 is made of InP with the conductivity type of the n-type and has the thickness of about 0.2 μm. The electrode layer 57 is made of Ti and has the thickness of about 0.03 μm. These contact layer 55 and electrode layer 57 constitute an electron releasing portion 59 of circular shape in the central region of the upper surface of the semiconductor electron emission layer 51.

Stripe apertures with the width of about 1.4 μm and the space of about 1.4 μm are formed in the contact layer 55 and electrode layer 57 in the electron releasing portion 59 by conventional lithography and etching techniques. A thin active layer 61 of an alkali metal, for example, such as Cs (or an oxide thereof) is evaporated on portions without the contact layer 55 and electrode layer 57 in the electron releasing portion 59, i.e., exposed portions of the semiconductor electron emission layer 51. This active layer 61 lowers the work function of the exposed surface of the semiconductor electron emission layer 51 so as to facilitate the release of the photoelectrons ($e^-$) accelerated in the semiconductor electron emission layer 51, into vacuum.

Furthermore, insulating layers 63 of rectangular shape are formed opposite to each other with the electron releasing portion 59 in between on the semiconductor electron emission layer 51. A first electrode 65 of circular shape is formed on each insulating layer 53. The insulating layers 63 are made, for example, of SiN and have the thickness of about 0.4 μm. The first electrodes 65 are integrally formed with the electron releasing portion 59 from the electrode layer 57 forming the electron releasing portion 59 and are electrically connected to the electron releasing portion 59. Formed on the lower surface of the semiconductor substrate 47 is a second electrode 53 in ohmic contact with the lower surface. This second electrode 53 is made, for example, of AuZn.

In this photocathode plate 23A, when light (hν) is incident from the semiconductor substrate 47 side, the light (hν) is absorbed by the semiconductor light absorbing layer 49 to be photoelectrically converted. Photoelectrons ($e^-$) generated thereby are accelerated toward the electron releasing portion 59 while passing the inside of the semiconductor electron emission layer 51, by an electric field generated by a bias voltage applied between the first electrodes 65 and the second electrode 53. Then the photoelectrons ($e^-$) thus accelerated are released from the apertures of the contact layer 55 and electrode layer 57 in the electron releasing portion 59 to the outside.

Figure 7:
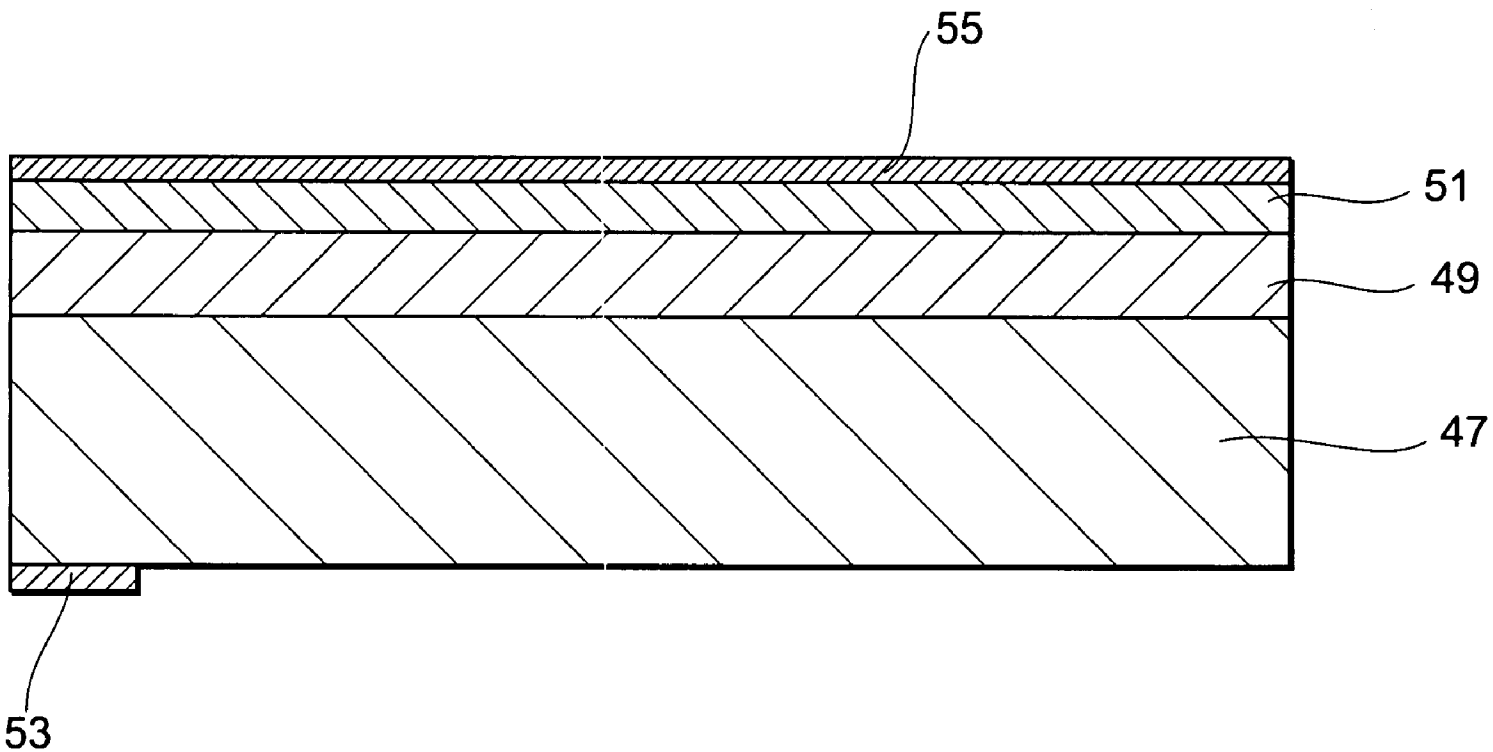
FIG. 7 is a sectional view showing a production step of the photocathode plate shown in FIG. 6.

For producing the photocathode plate 23A in the structure as described above, a semiconductor substrate 47 of InP with the conductivity type of the p-type is first prepared as shown in FIG. 7. Then a semiconductor light absorbing layer 49 of InGaAs with the conductivity type of the p-type, a semiconductor electron emission layer 51 of InP with the conductivity type of the p-type, and a contact layer 55 of InP with the conductivity type of the n-type are laid in this order on the semiconductor substrate 47. Furthermore, a second electrode 53 of AuZn is formed on the lower surface of the semiconductor substrate 47.

Figure 8:
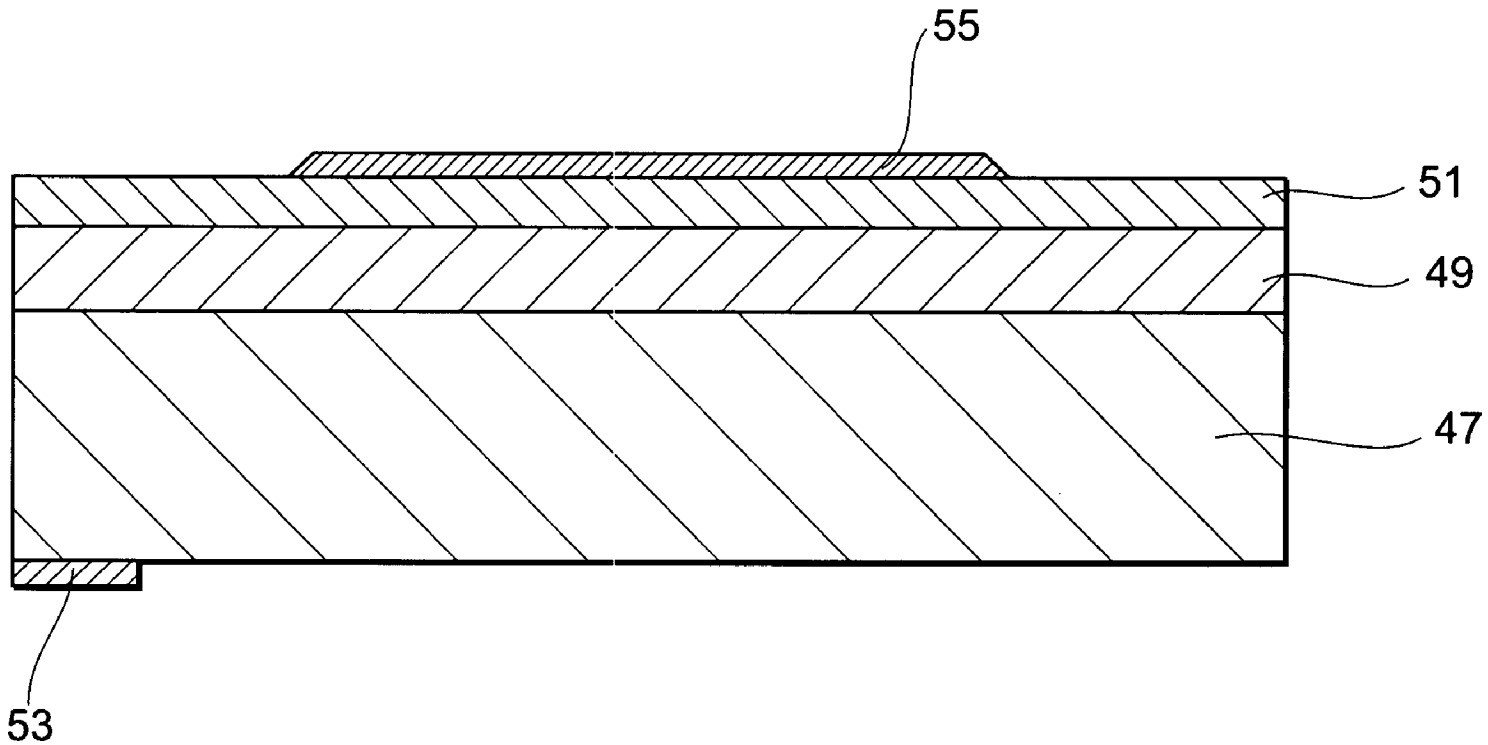
FIG. 8 is a sectional view showing a step subsequent to FIG. 7.
Figure 9:
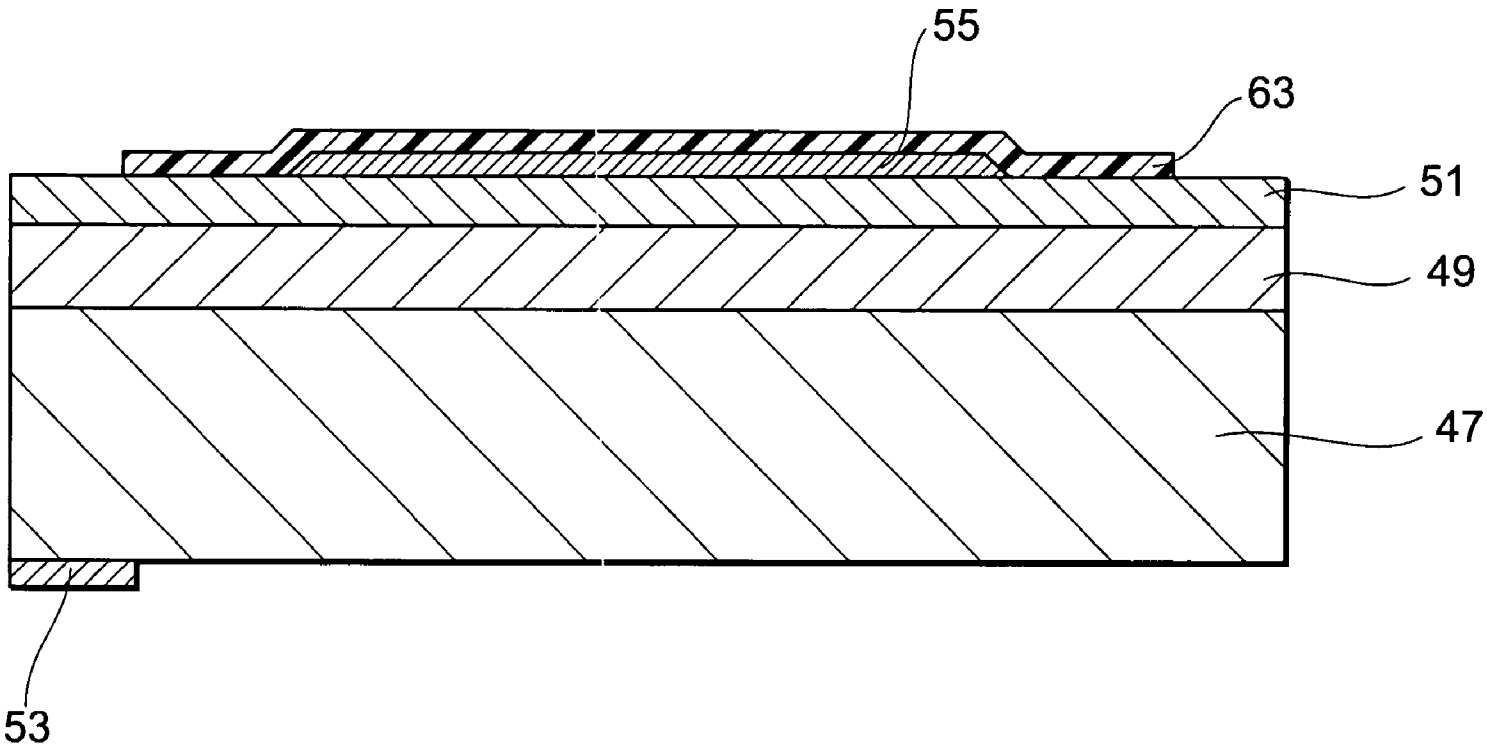
FIG. 9 is a sectional view showing a step subsequent to FIG. 8.
Figure 10:
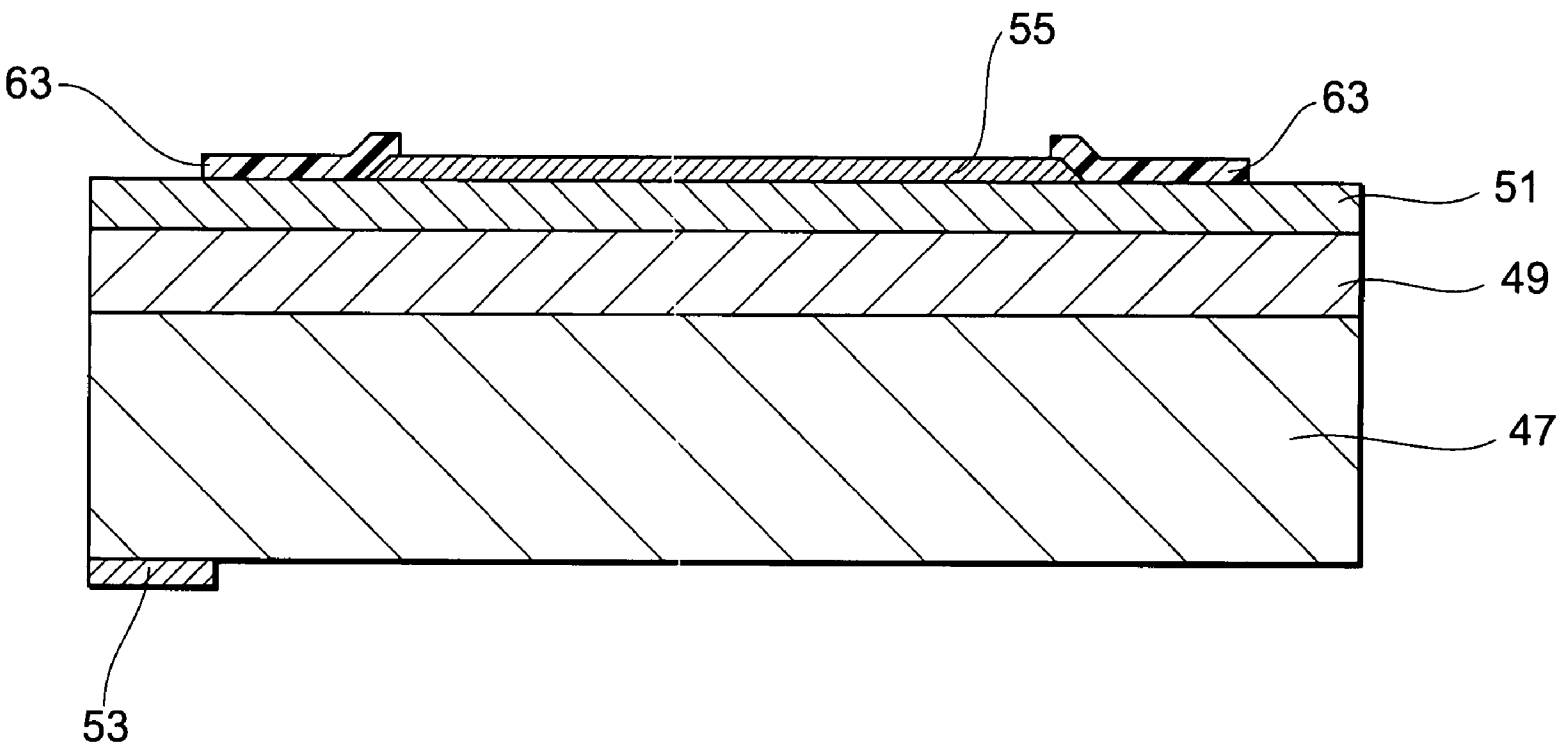
FIG. 10 is a sectional view showing a step subsequent to FIG. 9.

Then, as shown in FIG. 8, an etching process with a predetermined photoresist (not shown) is carried out to leave the contact layer 55 in circular shape in the central region of the upper surface of the semiconductor electron emission layer 51, while removing the contact layer 55 from the other region. Furthermore, as shown in FIG. 9, an insulating layer 63 of SiN is deposited so as to cover the upper surfaces of the contact layer 55 and the semiconductor electron emission layer 51. Then, as shown in FIG. 10, an etching process with a predetermined photoresist (not shown) is carried out to remove the insulating layer 63 while leaving regions of rectangular shape including the portions where the first electrodes 65 are to be formed.

Figure 11:
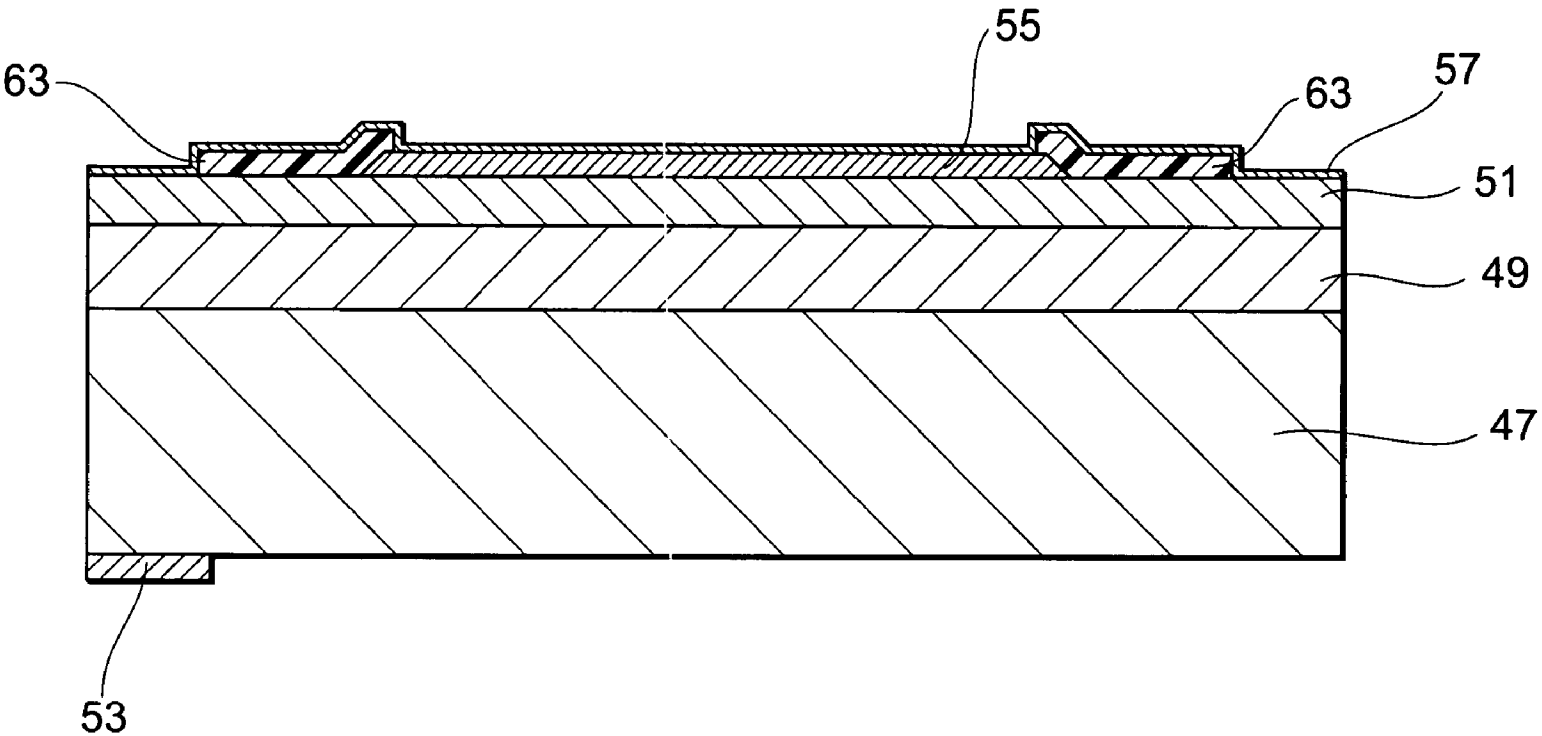
FIG. 11 is a sectional view showing a step subsequent to FIG. 10.

Next, as shown in FIG. 11, an electrode layer 57 of Ti is deposited so as to cover the upper surfaces of the semiconductor electron emission layer 51, contact layer 55, and insulating layers 63. Then an etching process with a predetermined photoresist (not shown) is carried out to form the electron releasing portion 59 while leaving the contact layer 55 and the electrode layer 57 so as to form the stripe apertures, in the central region of the upper surface of the semiconductor electron emission layer 51. At the same time, a pair of first electrodes 65 are formed while leaving the electrode layers 57 in circular shape at the opposite positions with the electron releasing portion 59 in between.

Furthermore, heat cleaning at a high temperature is carried out to clean the exposed portions of the semiconductor electron emission layer 51 in the electron releasing portion 59, and thereafter an alkali metal such as Cs is evaporated over the exposed portions to form the active layer 61, thereby completing the photocathode plate 23A shown in FIGS. 5 and 6.

As described above, the photomultiplier tube 1 of the present embodiment uses the photocathode plate 23A in which the insulating layers 63 are formed between the semiconductor electron emission layer 51 and the first electrodes 65 electrically connected to the electron releasing portion 59. By forming such insulating layers 63, it becomes feasible to perform the heat cleaning at a high temperature for the photocathode plate 23A, in a stage prior to formation of the active layer 61 in the exposed portions of the semiconductor electron emission layer 51 in the electron releasing portion 59. This process effectively cleans the exposed portions of the semiconductor electron emission layer 51 in the electron releasing portion 59, thereby enabling stabilization of the physical properties of the exposed portions. As a result, the photocathode plate 23A and the photomultiplier tube 1 using the photocathode plate 23A are able to stably achieve a high sensitive property.

The formation of the insulating layers 63 as described above provides the following additional effects. Namely, they enhance the mechanical strength of the photocathode plate 23A. This makes it feasible to prevent breakage of the semiconductor light absorbing layer 49 and the semiconductor electron emission layer 51 when the support plate 39 and others are brought into contact with the first electrodes 65. In the regions where the insulating layers 63 are formed, the semiconductor electron emission layer 51 is effectively protected from attachment of impurities. Furthermore, electrons are prevented from flowing directly from the semiconductor electron emission layer 51 into the first electrodes 65, so as to suppress occurrence of dark current.

Although the space is extremely narrow between the support plate 39 in electrical contact with the photocathode plate 23A and the semiconductor electron emission layer 51 in the photocathode plate 23A, such trouble as contact between the second electroconductive film 43 and the semiconductor electron emission layer 51 rarely occurs in the regions with the insulating layers 63 even if the support plate 39 expands and contracts, for example, with temperature change or the like.

Figure 12:
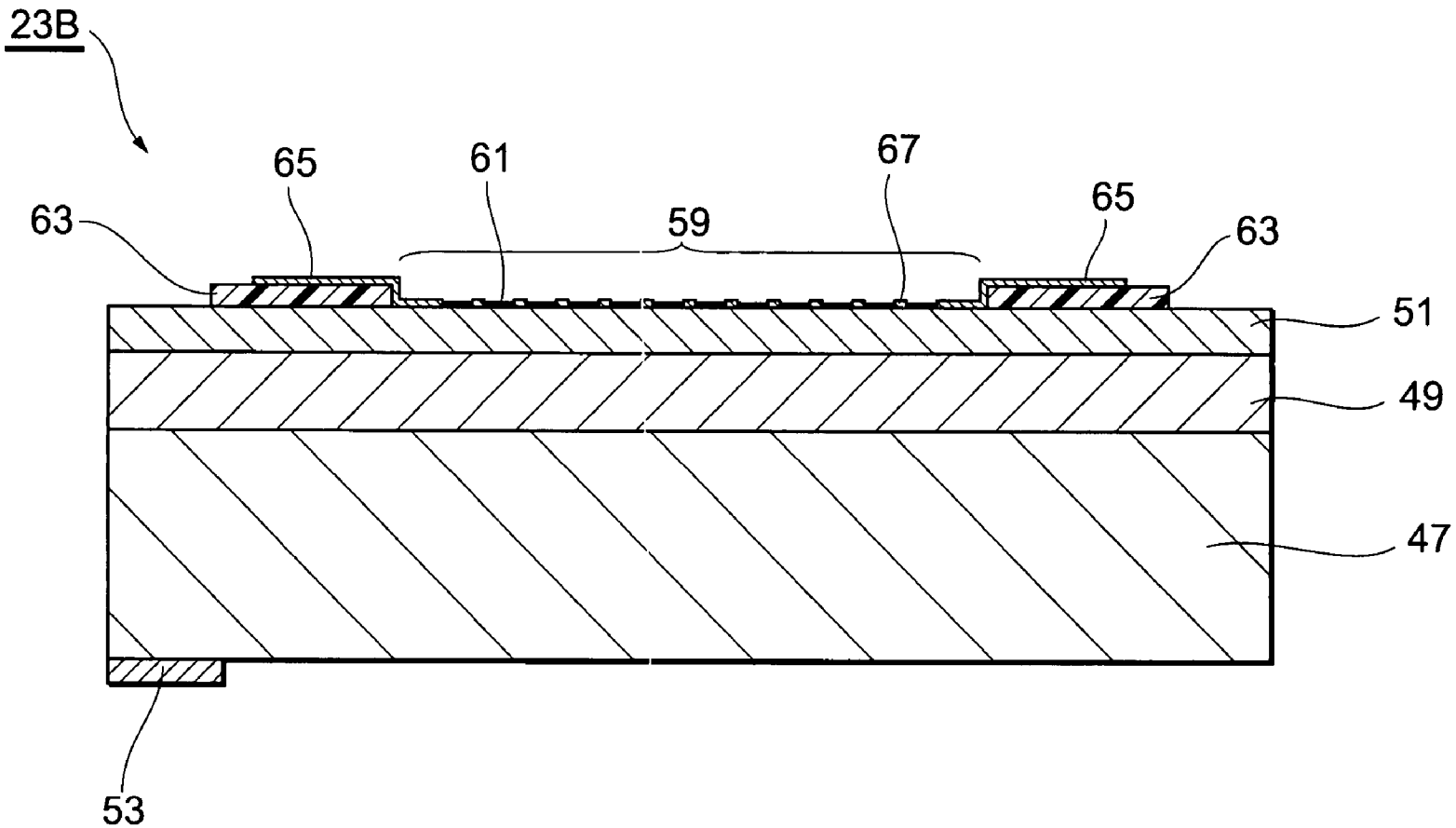
FIG. 12 is a sectional view showing a modification example of the photocathode plate according to the first embodiment.

As a modification example of the present embodiment, a photocathode plate 23B of the Schottky type as shown in FIG. 12 may also be adopted for the photomultiplier tube 1. This photocathode plate 23B is different from the above-described embodiment with the electron releasing portion 59 and the first electrodes 65 formed from the contact layer 55 and the electrode layer 57, in that they are formed from a Schottky electrode layer 67.

Namely, the photocathode plate 23B is formed without the contact layer 55 on the semiconductor electron emission layer 51, and the electron releasing portion 59 is formed by directly laying the Schottky electrode layer 67 on the semiconductor electron emission layer 51. The first electrodes 65 are formed from the Schottky electrode layer 67 laid through the insulating layers 63 on the semiconductor electron emission layer 51.

Figure 13:
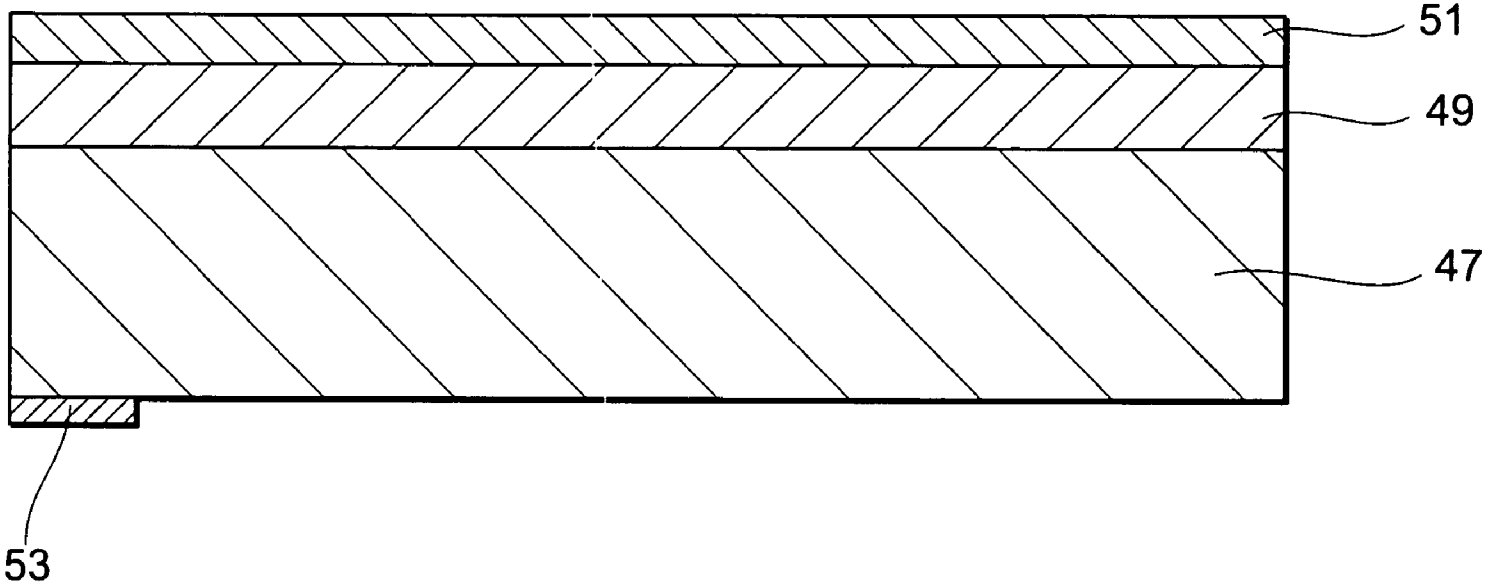
FIG. 13 is a sectional view showing a production step of the photocathode plate shown in FIG. 12.

For producing the photocathode plate 23B of this structure, a semiconductor substrate 47 of InP with the conductivity type of the p-type is first prepared as shown in FIG. 13. Then a semiconductor light absorbing layer 49 of InGaAs with the conductivity type of the p-type and a semiconductor electron emission layer 51 of InP with the conductivity type of the p-type are deposited in this order on the semiconductor substrate 47. Furthermore, a second electrode 53 of AuZn is formed on the lower surface of the semiconductor substrate 47.

Figure 14:
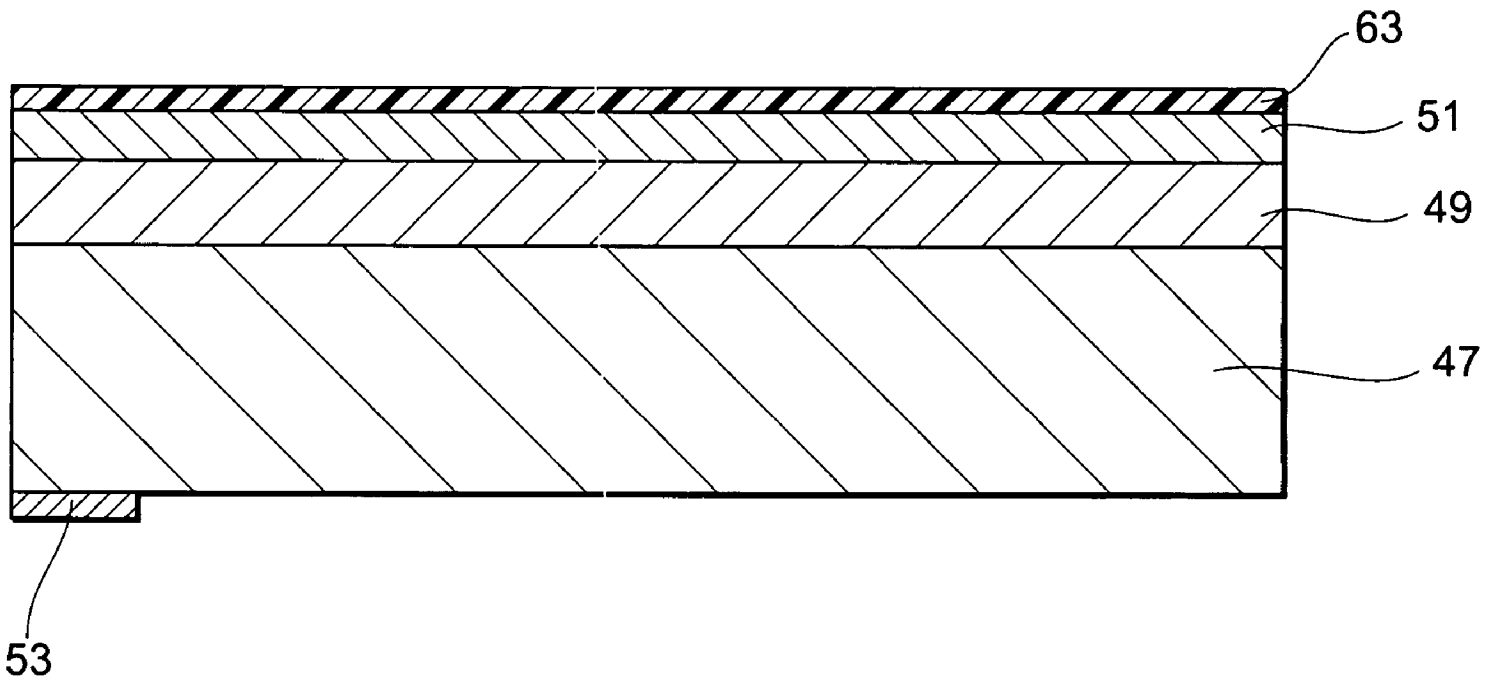
FIG. 14 is a sectional view showing a step subsequent to FIG. 13.
Figure 15:
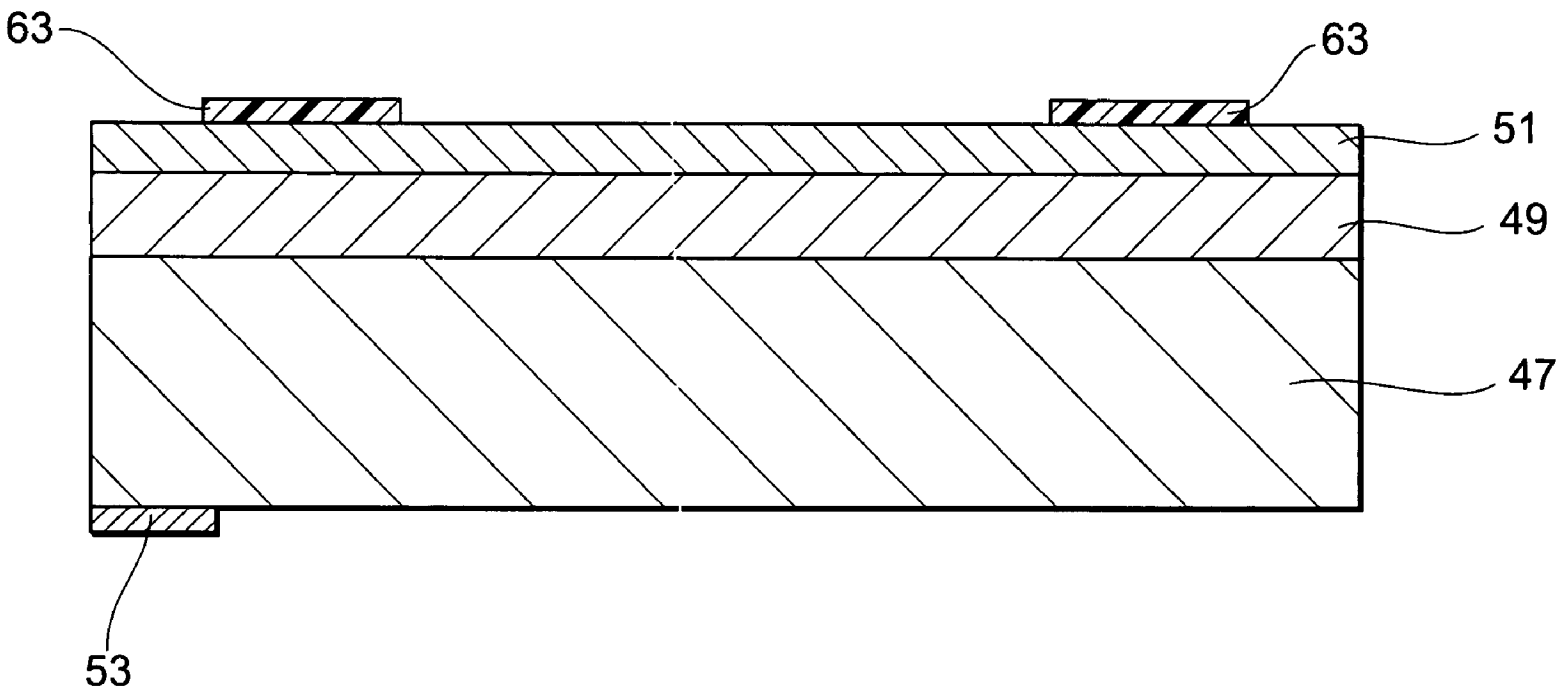
FIG. 15 is a sectional view showing a step subsequent to FIG. 14.

Next, as shown in FIG. 14, an insulating layer 63 of SiN is deposited over the entire upper surface of the semiconductor electron emission layer 51. Then, as shown in FIG. 15, an etching process with a predetermined photoresist (not shown) is carried out to remove the insulating layer 63 while leaving the regions of rectangular shape including the portions where the first electrodes 65 are to be formed.

Figure 16:
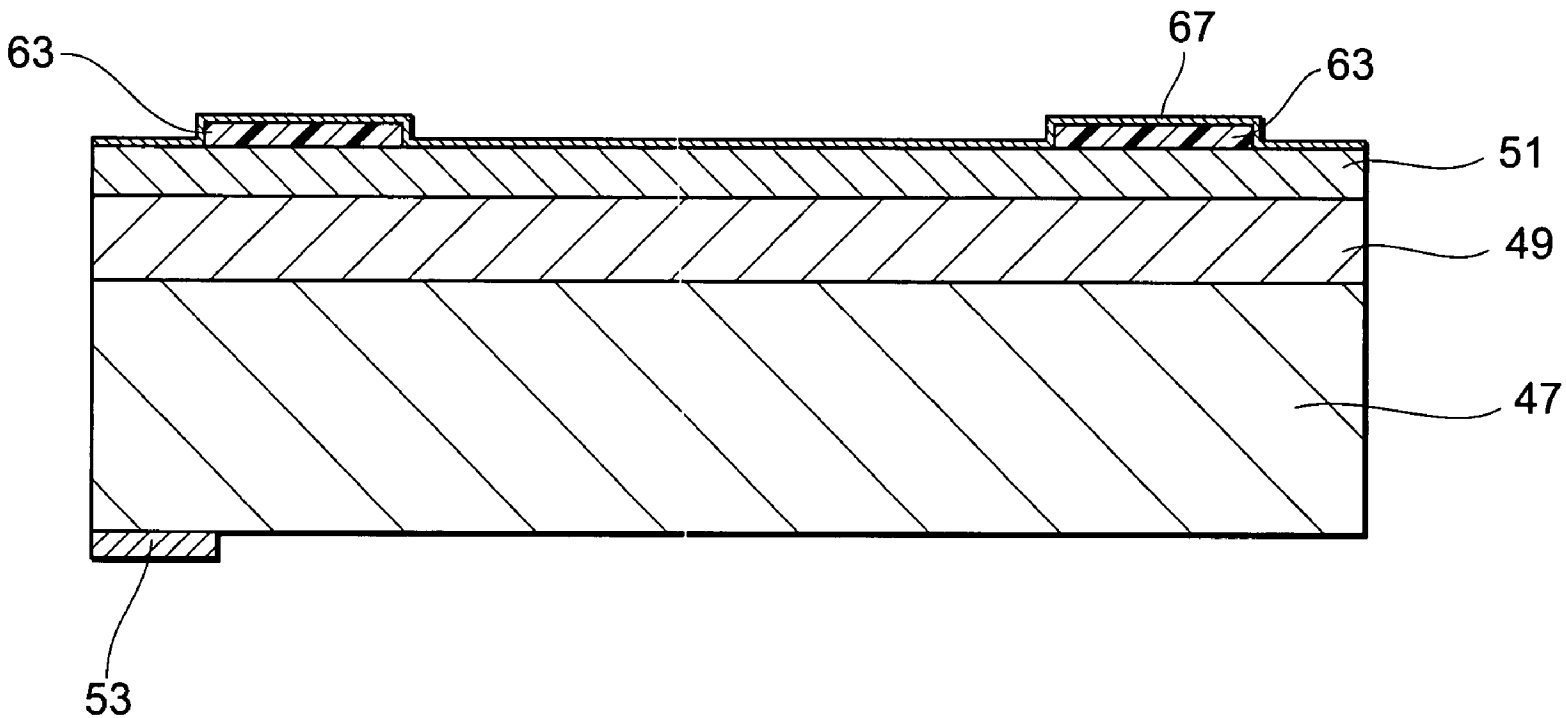
FIG. 16 is a sectional view showing a step subsequent to FIG. 15.

Furthermore, as shown in FIG. 16, a Schottky electrode layer 67 is deposited so as to cover the upper surfaces of the insulating layers 63 and the semiconductor electron emission layer 51. Then an etching process with a predetermined photoresist (not shown) is carried out to form the electron releasing portion 59 while leaving the Schottky electrode layer 67 so as to form the stripe apertures, in the central region of the upper surface of the semiconductor electron emission layer 51. At the same time, a pair of first electrodes 65 are formed while leaving the Schottky electrode layers 67 in circular shape at the opposite positions with the electron releasing portion 59 in between.

Furthermore, heat cleaning at a high temperature is carried out to clean the exposed portions of the semiconductor electron emission layer 51 in the electron releasing portion 59, and thereafter an alkali metal such as Cs is evaporated over the exposed portions to form the active layer 61, thereby completing the photocathode plate 23B shown in FIG. 12.

Since the insulating layers 63 are formed between the semiconductor electron emission layer 51 and the first electrodes 65 electrically connected to the electron releasing portion 59, the photocathode plate 23B is also able to achieve the same effects as in the aforementioned embodiment.

Second Embodiment

Figure 17:
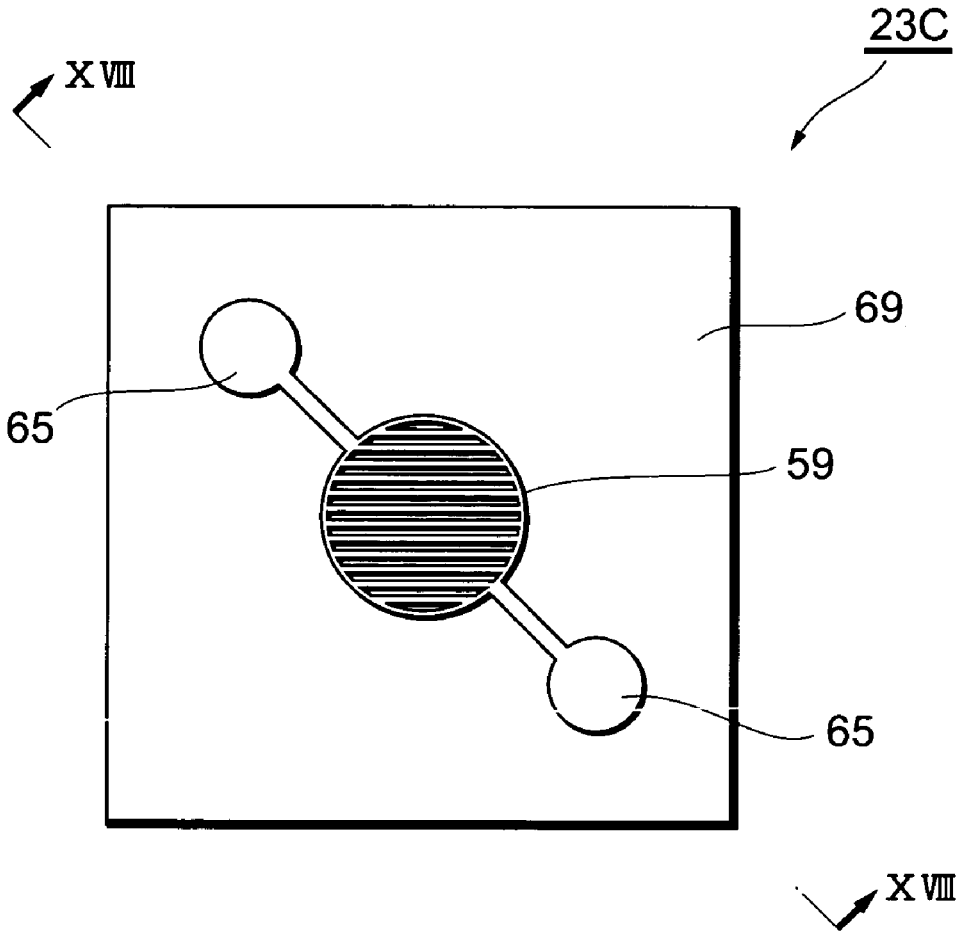
FIG. 17 is a plan view showing a second embodiment of the photocathode plate according to the present invention.
Figure 18:
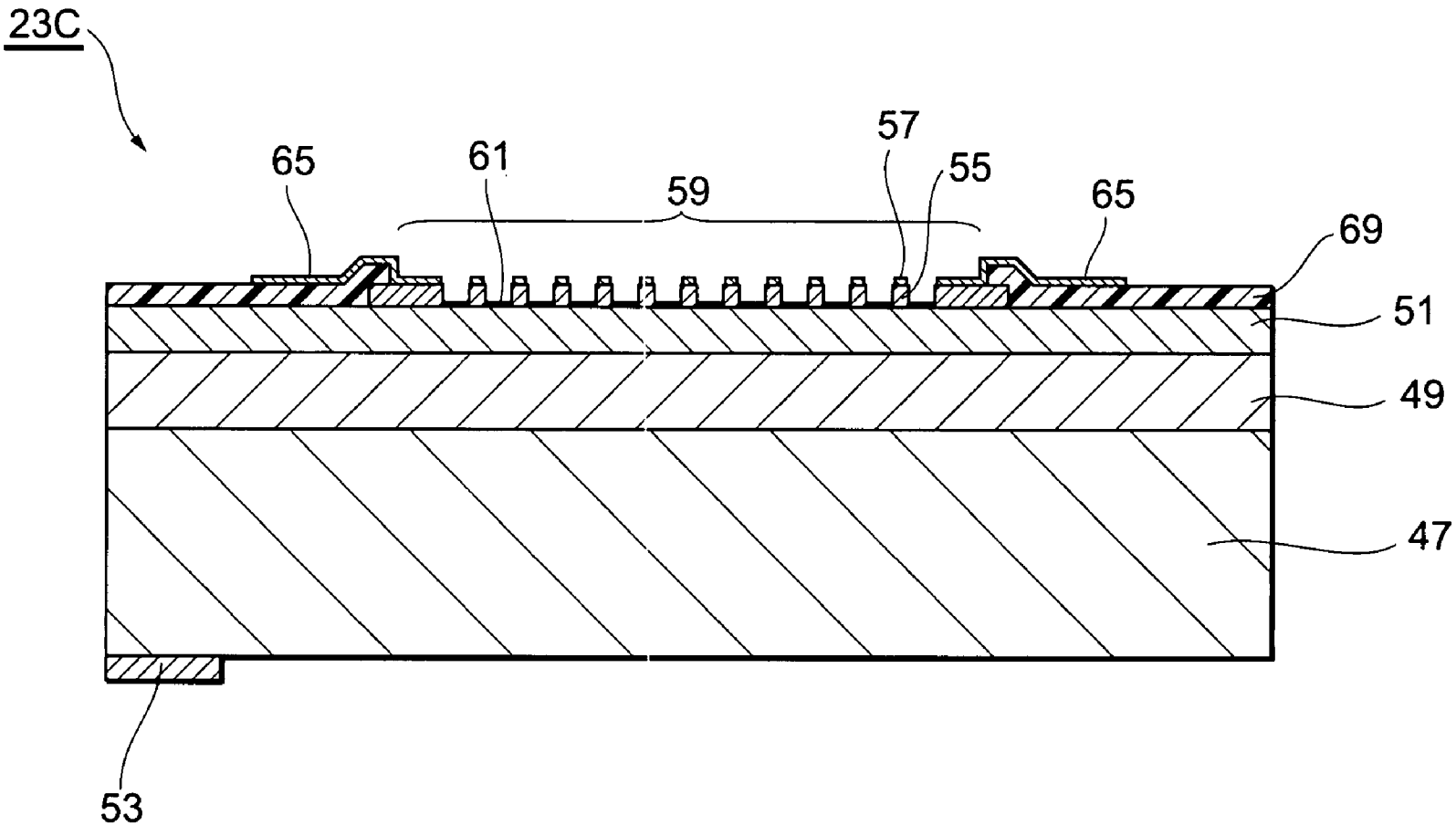
FIG. 18 is a sectional view along XVIII—XVIII line of the photocathode plate shown in FIG. 17.

In a photomultiplier tube being an electron tube of the second embodiment, the layer structure of the photocathode plate 23C incorporated therein is different from that of the photocathode plate 23A in the first embodiment. Namely, the photocathode plate 23C, as shown in FIGS. 17 and 18, is different from the photocathode plate 23A with the insulating layers 63 being formed only in the partial regions on the semiconductor electron emission layer 51, in that an insulating layer 69 is formed so as to cover a region without the electron releasing portion 59 on the semiconductor electron emission layer 51.

Figure 19:
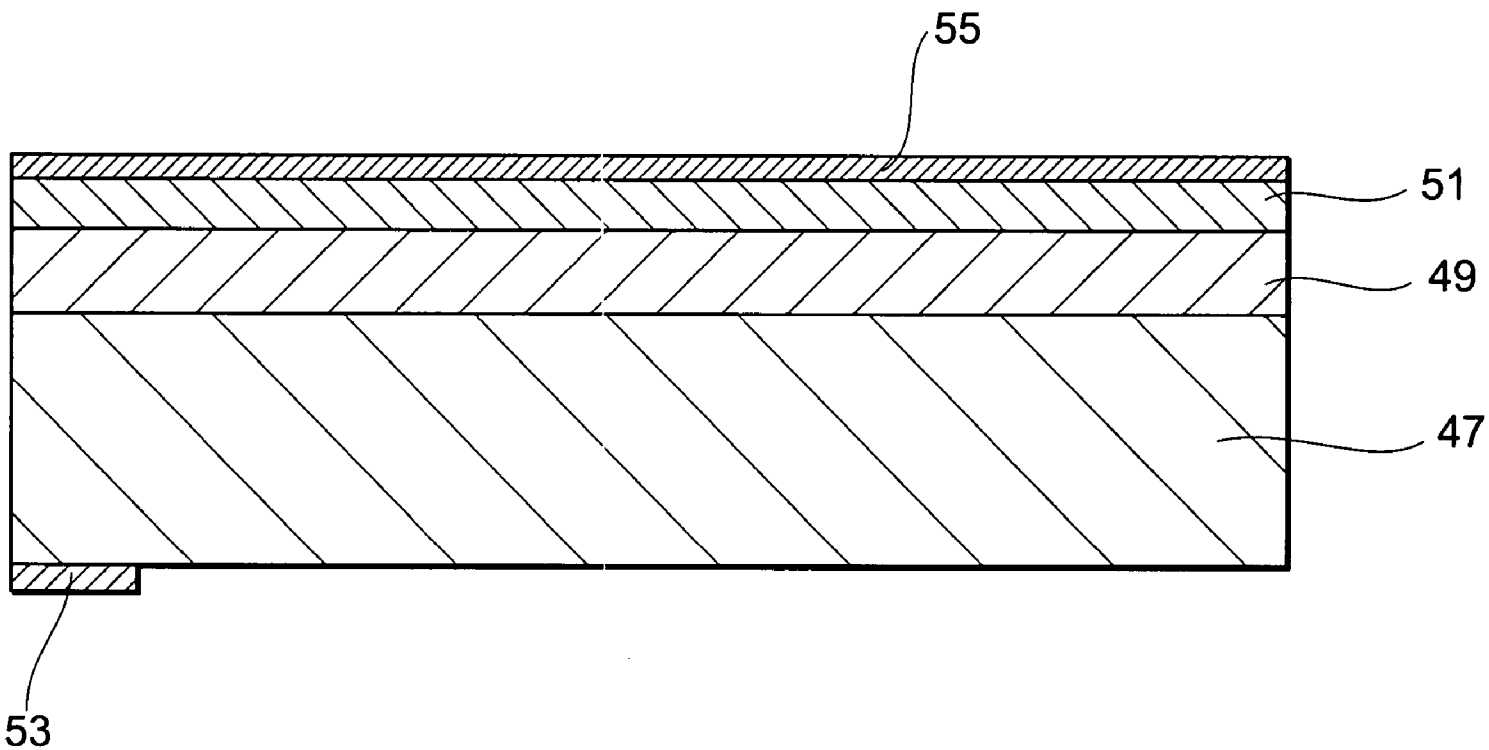
FIG. 19 is a sectional view showing a production step of the photocathode plate shown in FIG. 18.

For producing the photocathode plate 23C of this configuration, a semiconductor substrate 47 of InP with the conductivity type of the p-type is first prepared as shown in FIG. 19. Then a semiconductor light absorbing layer 49 of InGaAs with the conductivity type of the p-type, a semiconductor electron emission layer 51 of InP with the conductivity type of the p-type, and a contact layer 55 of InP with the conductivity type of the n-type are deposited in this order on the semiconductor substrate 47. Furthermore, a second electrode 53 of AuZn is formed on the lower surface of the semiconductor substrate 47.

Figure 20:
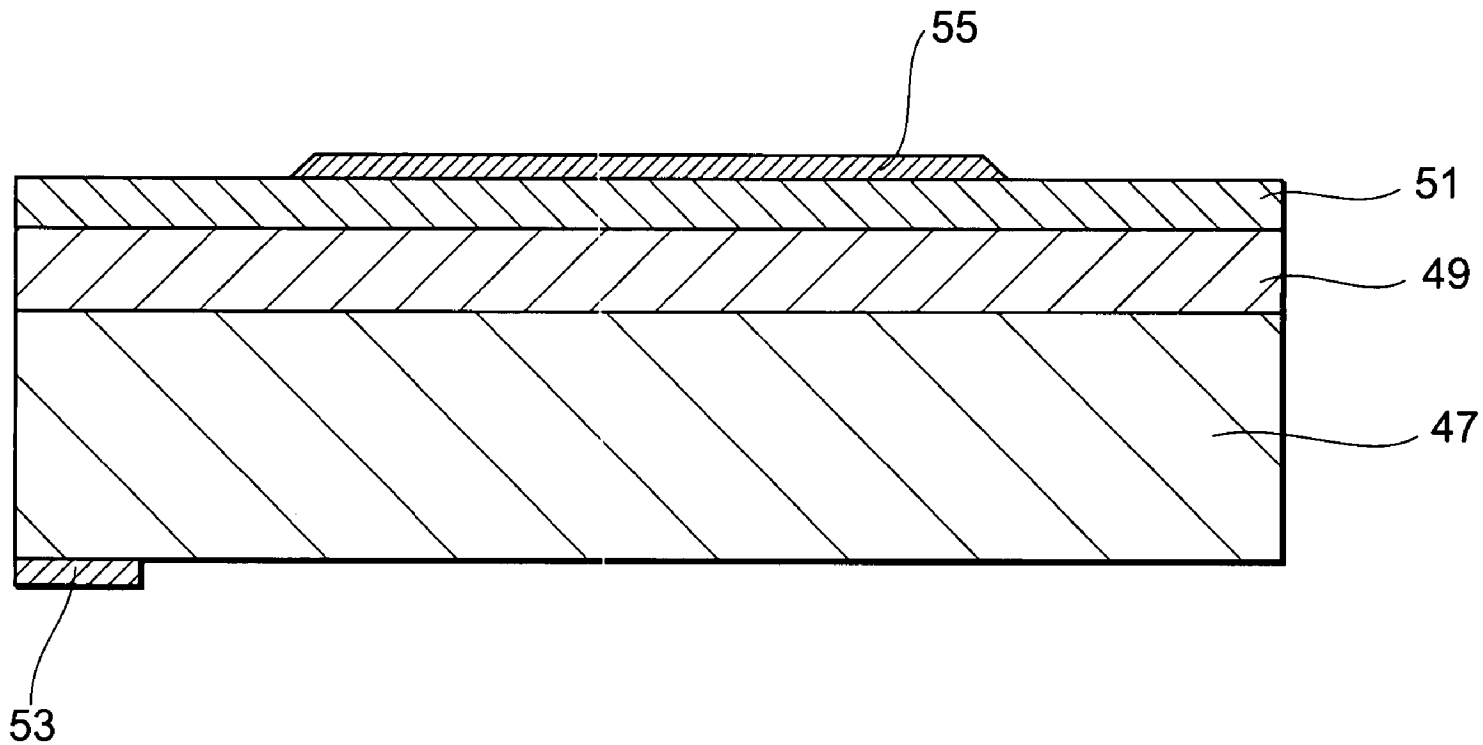
FIG. 20 is a sectional view showing a step subsequent to FIG. 19.
Figure 21:
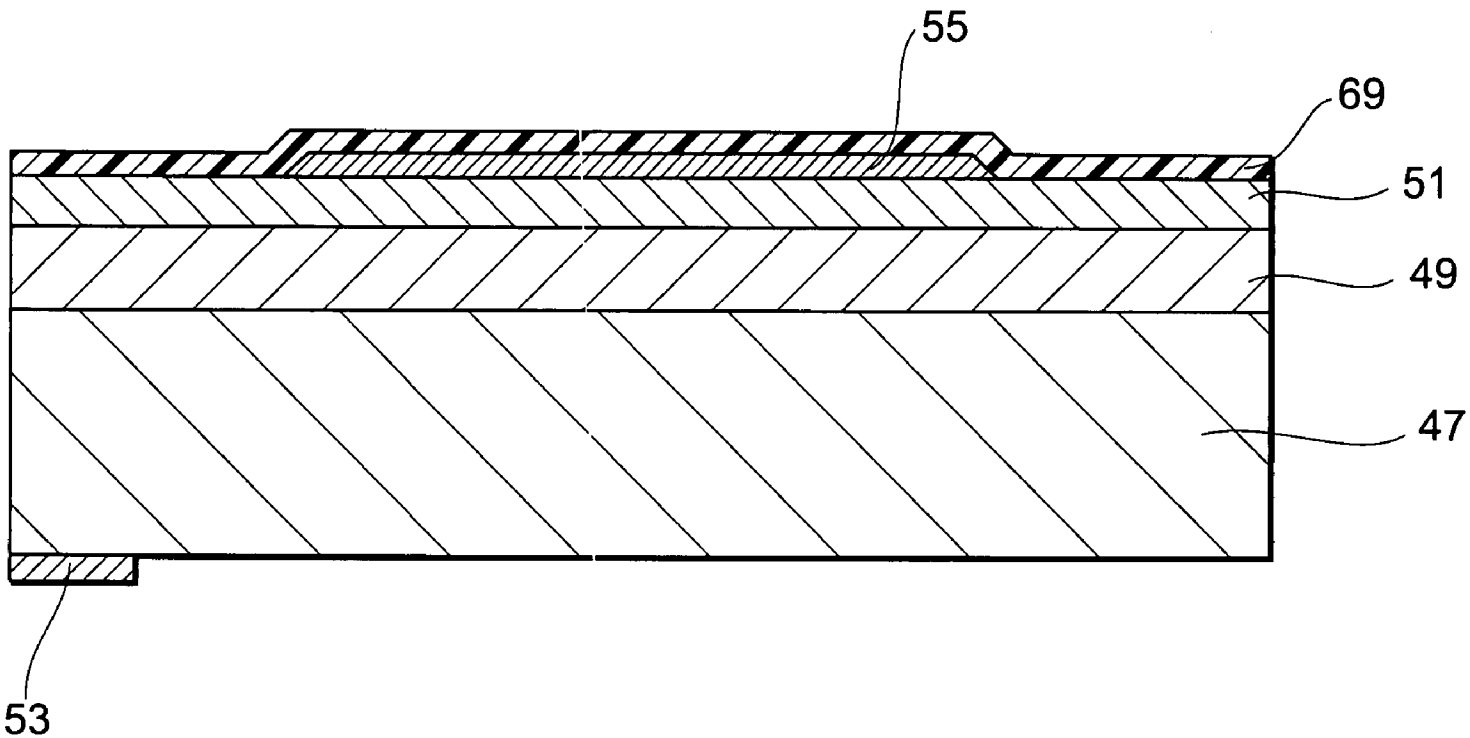
FIG. 21 is a sectional view showing a step subsequent to FIG. 20.
Figure 22:
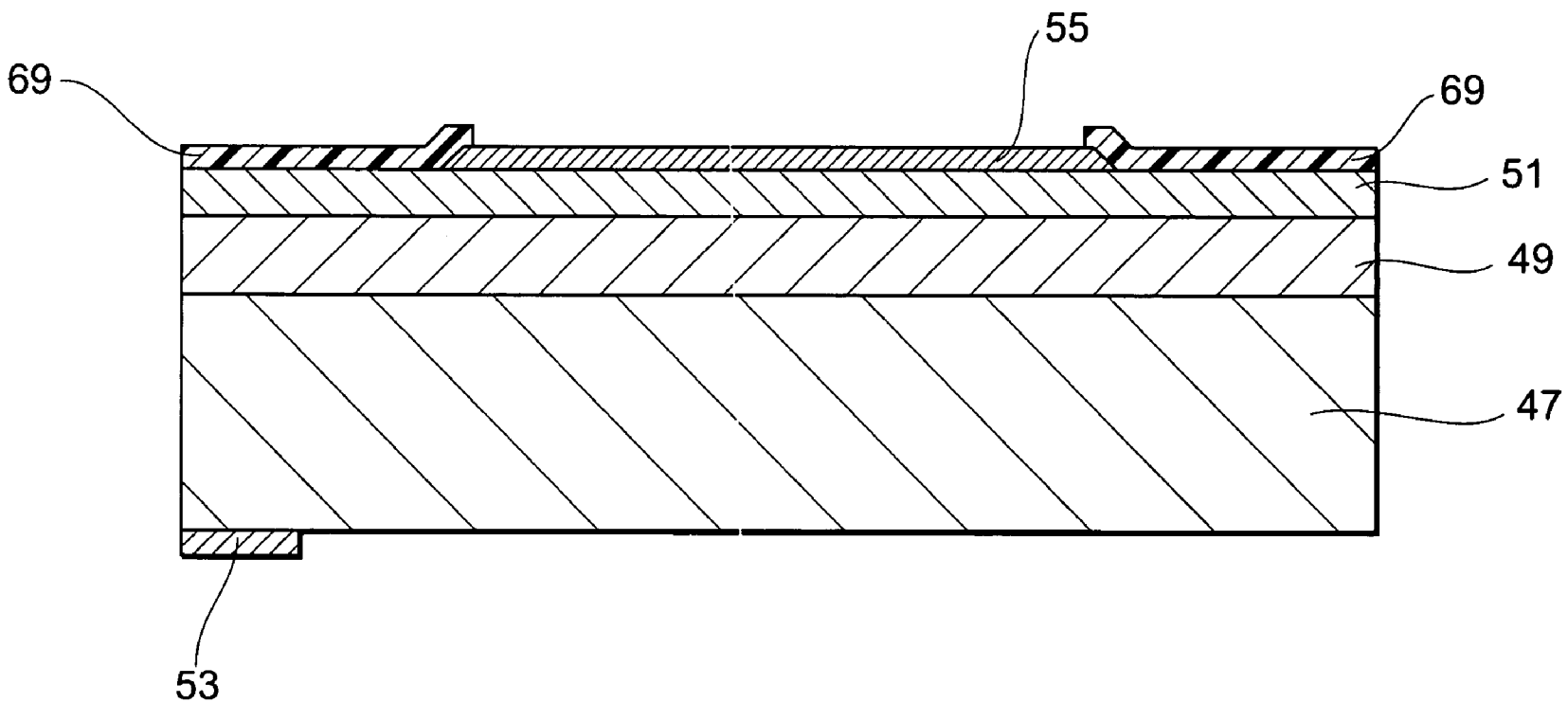
FIG. 22 is a sectional view showing a step subsequent to FIG. 21.

Next, as shown in FIG. 20, an etching process with a predetermined photoresist (not shown) is carried out to leave the contact layer 55 in circular shape in the central region of the upper surface of the semiconductor electron emission layer 51, while removing the contact layer 55 from the other region. Furthermore, as shown in FIG. 21, an insulating layer 69 of SiN is deposited so as to cover the upper surfaces of the contact layer 55 and the semiconductor electron emission layer 51. Then, as shown in FIG. 22, an etching process with a predetermined photoresist (not shown) is carried out to remove the insulating layer 69 so as to expose the upper surface of the contact layer 55 in circular shape.

Figure 23:
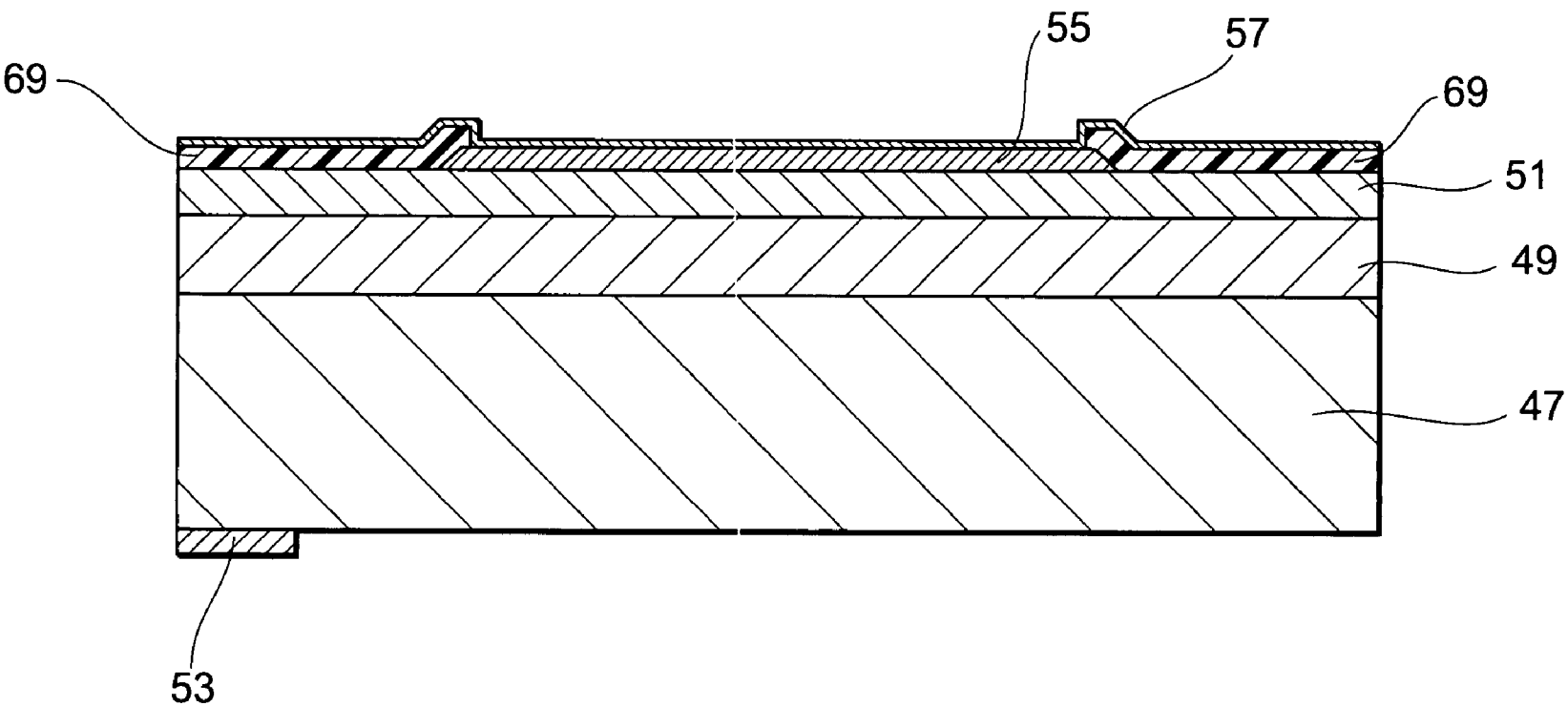
FIG. 23 is a sectional view showing a step subsequent to FIG. 22.

Next, as shown in FIG. 23, an electrode layer 57 of Ti is deposited so as to cover the upper surfaces of the contact layer 55 and the insulating layer 69. Then an etching process with a predetermined photoresist (not shown) is carried out to form the electron releasing portion 59 while leaving the contact layer 55 and the electrode layer 57 so as to form the stripe apertures, in the central region of the upper surface of the semiconductor electron emission layer 51. At the same time, a pair of first electrodes 65 are formed while leaving the electrode layers 57 in circular shape at the opposite positions with the electron releasing portion 59 in between.

Furthermore, heat cleaning at a high temperature is carried out to clean the exposed portions of the semiconductor electron emission layer 51 in the electron releasing portion 59, and thereafter an alkali metal such as Cs is evaporated over the exposed portions to form the active layer 61, thereby completing the photocathode plate 23C shown in FIGS. 17 and 18.

In the photocathode plate 23C constructed as described above, the insulating layer 69 is also formed between the semiconductor electron emission layer 51 and the first electrodes 65 electrically connected to the electron releasing portion 59. Furthermore, this insulating layer 69 is formed so as to cover the region without the electron releasing portion 59 on the semiconductor electron emission layer 51. Since this insulating layer 69 further enhances the temperature resistance of the photocathode plate 23C, it becomes feasible to perform the heat cleaning at a higher temperature. This permits the exposed portions of the semiconductor electron emission layer 51 in the electron releasing portion 59 to be more effectively cleaned, whereby the physical properties of the exposed portions can be more stabilized. As a result, the photocathode plate 23C and the photomultiplier tube using the photocathode plate 23C are able to stably achieve a higher sensitive property.

The formation of the insulating layer 69 as described above provides the following additional effects. Namely, it enhances the mechanical strength of the photocathode plate 23C. This prevents breakage of the semiconductor light absorbing layer 49 and the semiconductor electron emission layer 51 when the support plate 39 and others are brought into contact with the first electrodes 65. Since the insulating layer 69 prevents the semiconductor electron emission layer 51 from being exposed in the region without the electron releasing portion 59, it can effectively protect the semiconductor electron emission layer 51 from attachment of impurities. Furthermore, it effectively prevents electrons from directly flowing from the semiconductor electron emission layer 51 into the first electrodes 65, so as to suppress occurrence of dark current more.

Although the space is extremely narrow between the support plate 39 in electric contact with the photocathode plate 23C and the semiconductor electron emission layer 51 in the photocathode plate 23C, such trouble as contact between the second electroconductive film 43 and the semiconductor electron emission layer 51 rarely occurs in the region with the insulating layer 69 even if the support plate 39 expands and contracts, for example, with temperature change or the like.

Figure 24:
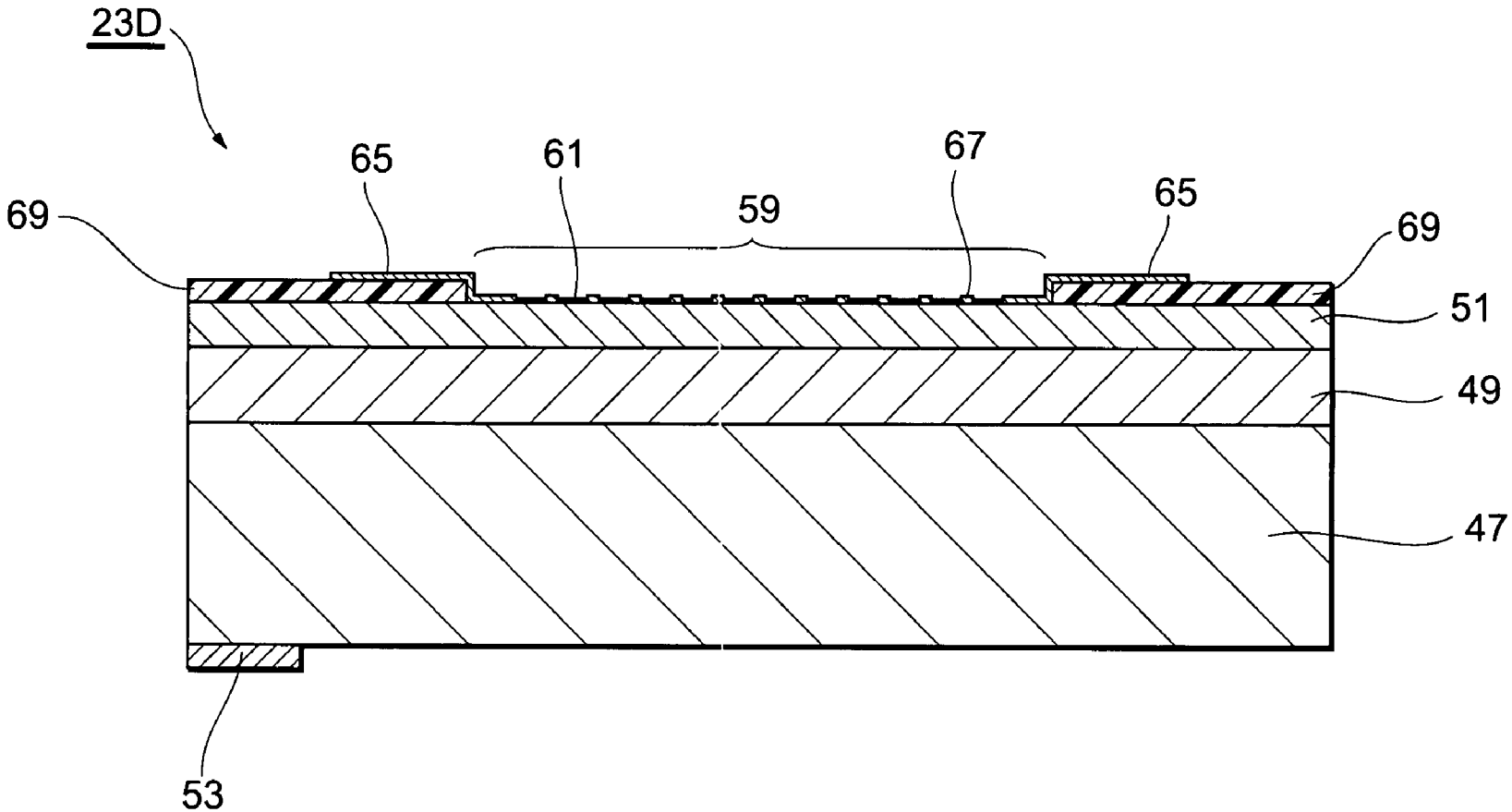
FIG. 24 is a sectional view showing a modification example of the photocathode plate according to the second embodiment.

As a modification example of the present embodiment, a photocathode plate 23D of the Schottky type as shown in FIG. 24 may also be adopted for the photomultiplier tube.

Figure 25:
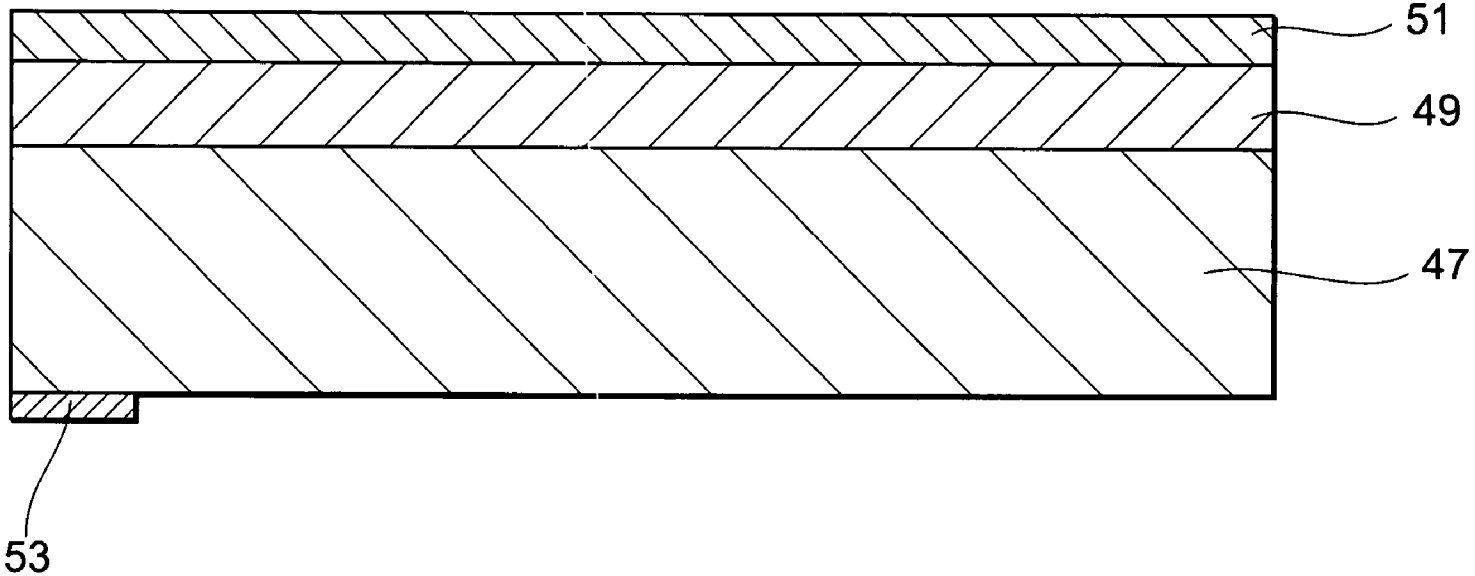
FIG. 25 is a sectional view showing a production step of the photocathode plate shown in FIG. 24.

For producing the photocathode plate 23D of this configuration, a semiconductor substrate 47 of InP with the conductivity type of the p-type is first prepared as shown in FIG. 25. Then a semiconductor light absorbing layer 49 of InGaAs with the conductivity type of the p-type and a semiconductor electron emission layer 51 of InP with the conductivity type of the p-type are deposited in this order on the semiconductor substrate 47. Furthermore, a second electrode 53 of AuZn is formed on the lower surface of the semiconductor substrate 47.

Figure 26:
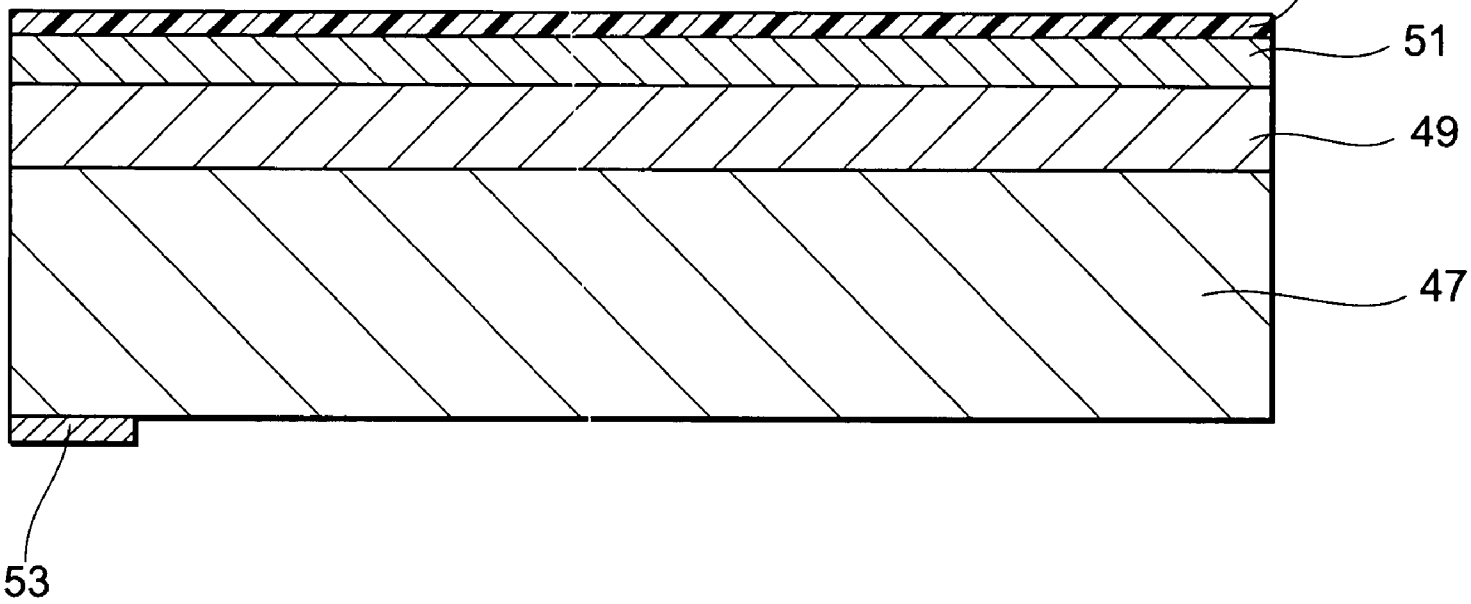
FIG. 26 is a sectional view showing a step subsequent to FIG. 25.
Figure 27:
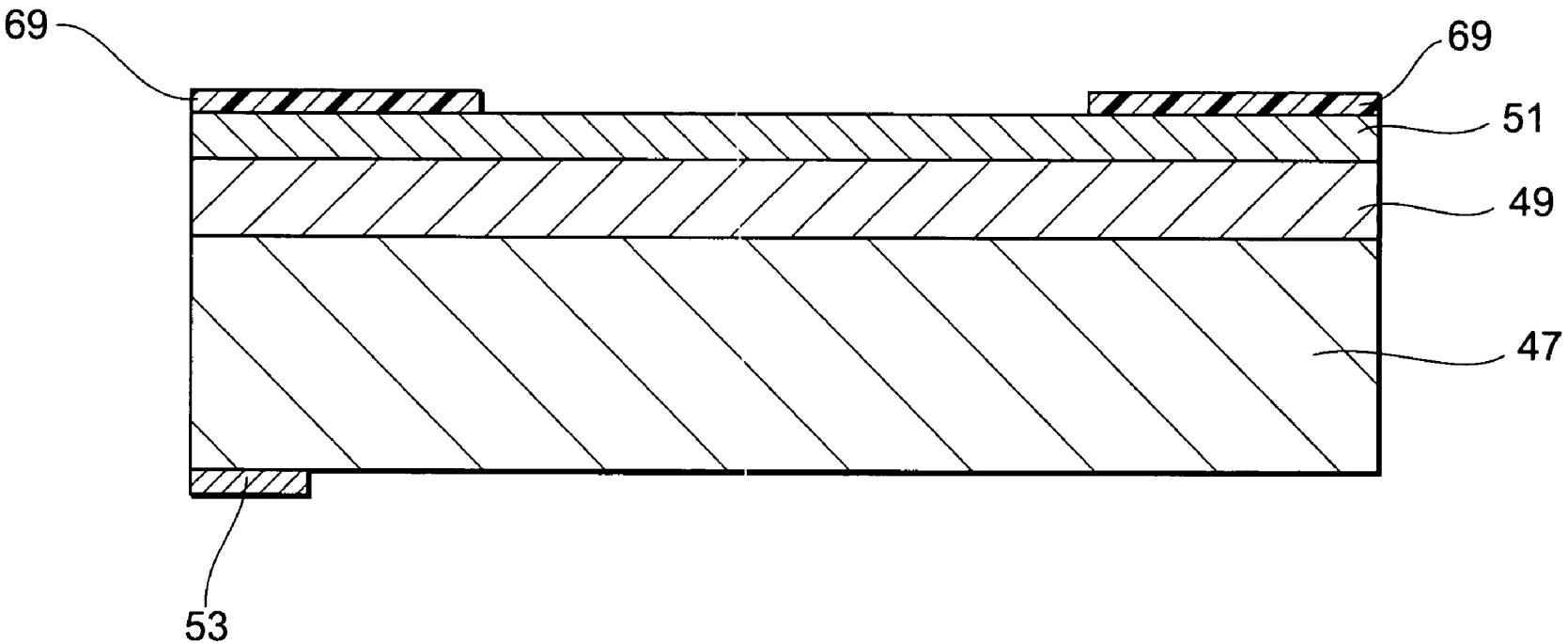
FIG. 27 is a sectional view showing a step subsequent to FIG. 26.

Next, as shown in FIG. 26, an insulating layer 69 of SiN is deposited over the entire upper surface of the semiconductor electron emission layer 51. Then, as shown in FIG. 27, an etching process with a predetermined photoresist (not shown) is carried out to remove the insulating layer 69 so as to expose it in circular shape in the central region of the upper surface of the semiconductor electron emission layer 51.

Figure 28:
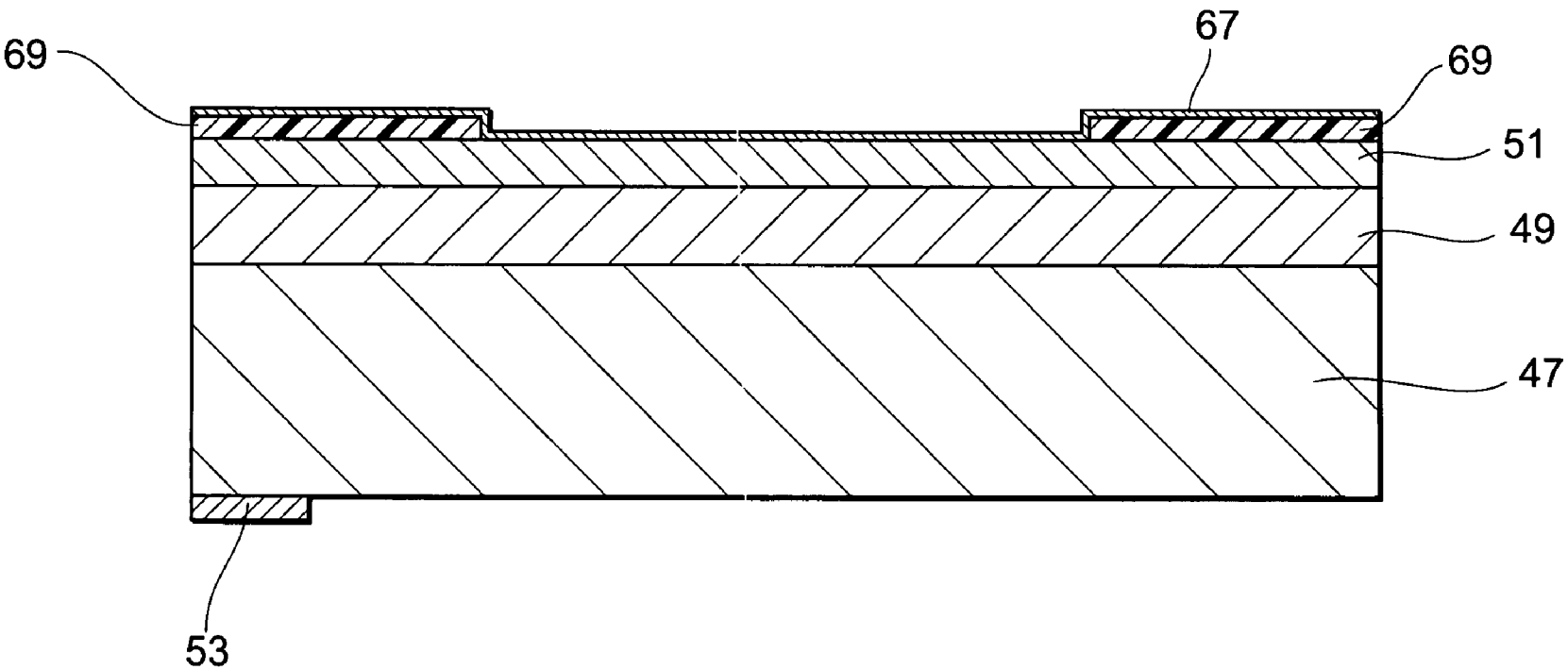
FIG. 28 is a sectional view showing a step subsequent to FIG. 27.

Furthermore, as shown in FIG. 28, a Schottky electrode layer 67 is deposited so as to cover the upper surfaces of the insulating layer 69 and the semiconductor electron emission layer 51. Then an etching process with a predetermined photoresist (not shown) is carried out so as to form the electron releasing portion 59 while leaving the Schottky electrode layer 67 so as to form the stripe apertures, in the central region of the upper surface of the semiconductor electron emission layer 51. At the same time, a pair of first electrodes 65 are formed so as to leave the Schottky electrode layers 67 in circular shape at the opposite positions with the electron releasing portion 59 in between. The above completes the photocathode plate 23D shown in FIG. 24.

In this photocathode plate 23D, the insulating layer 69 is also formed between the semiconductor electron emission layer 51 and the first electrodes 65 electrically connected to the electron releasing portion 59 and this insulating layer 69 is formed so as to cover the region without the electron releasing portion 59 on the semiconductor electron emission layer 51. Therefore, it is also able to achieve the same effects as in the embodiment shown in FIGS. 17 and 18.

As described above, the photocathode plates and electron tubes according to the present invention are able to stably achieve a high sensitive property.

What is claimed is:

1. A photocathode plate for releasing photoelectrons through photoelectric conversion of incident light, comprising:

a semiconductor substrate;

a semiconductor light absorbing layer formed on the semiconductor substrate and adapted to absorb incident light to generate photoelectrons;

a semiconductor electron emission layer formed on the semiconductor light absorbing layer and adapted to accelerate the photoelectrons generated in the semiconductor light absorbing layer;

an electron releasing portion formed on the semiconductor electron emission layer and adapted to outwardly release the photoelectrons accelerated by the semiconductor electron emission layer;

a first electrode electrically connected to the electron releasing portion;

an insulating layer formed between the semiconductor electron emission layer and the first electrode; and a second electrode formed on the semiconductor substrate.

2. The photocathode plate according to claim 1, wherein the insulating layer is formed so as to cover a region without the electron releasing portion on the semiconductor electron emission layer.

3. An electron tube comprising the photocathode plate as defined in claim 1.

4. An electron tube comprising the photocathode plate as defined in claim 2.

* * * * *